US010663876B2

(12) United States Patent
Kojima

(10) Patent No.: US 10,663,876 B2
(45) Date of Patent: May 26, 2020

(54) TONER, TONER CARTRIDGE, DEVELOPMENT DEVICE, AND IMAGE FORMING APPARATUS

(71) Applicant: Oki Data Corporation, Minato-ku, Tokyo (JP)

(72) Inventor: Takeshi Kojima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 2 days.

(21) Appl. No.: 16/194,910

(22) Filed: Nov. 19, 2018

(65) Prior Publication Data

US 2019/0163080 A1 May 30, 2019

(30) Foreign Application Priority Data

Nov. 30, 2017 (JP) ..... 2017-229772
Jul. 20, 2018 (JP) ..... 2018-136292

(51) Int. Cl.
*G03G 9/08* (2006.01)
*G03G 9/09* (2006.01)
*G03G 9/087* (2006.01)

(52) U.S. Cl.
CPC ..... *G03G 9/091* (2013.01); *G03G 9/0821* (2013.01); *G03G 9/08702* (2013.01); *G03G 9/08711* (2013.01); *G03G 9/08742* (2013.01); *G03G 9/0912* (2013.01); *G03G 9/0914* (2013.01); *G03G 9/0926* (2013.01); *G03G 2215/0614* (2013.01)

(58) Field of Classification Search
CPC ..... G03G 9/0821
USPC ..... 430/111.4
See application file for complete search history.

(56) References Cited

U.S. PATENT DOCUMENTS 6,432,598 B1 8/2002 Alexandrovich et al.
2009/0291377 A1 11/2009 Hirose et al.
2012/0251939 A1 10/2012 Tani et al.

FOREIGN PATENT DOCUMENTS

JP 2011-197032 A 10/2011
JP 2015-068889 A 4/2015

*Primary Examiner* — Mark A Chapman
(74) *Attorney, Agent, or Firm* — Panitch Schwarze Belisario & Nadel LLP

(57) ABSTRACT

A toner includes binder resin 101 and a coloring agent 102. The coloring agent 102 is configured so that hue of a hue measurement print image printed on a print medium with the toner satisfies $-8.6 \leq a^*(Y) \leq -7.9$ and $93.4 \leq b^*(Y) \leq 95.4$, where a*(Y) and b*(Y) represent an a* value and a b* value of the hue measurement print image and light resistance F of a light resistance measurement print image printed on a print medium with the toner, after an irradiation test in which the light resistance measurement print image is irradiated with light having 0.36 $W/m^2$ spectral irradiance at a wavelength of 340 nm for 663 hours, is higher than or equal to 70%. The toner is configured so that its melt viscosity at 120° C. is higher than or equal to 1400 Pa·s and lower than or equal to 1600 Pa·s.

15 Claims, 15 Drawing Sheets

FIG.14

TABLE 3

| EXAMPLE/ COMPARATIVE EXAMPLE | YELLOW TONER | PIGMENT COMPOUNDING RATIO PY155:PY185 | PRINT HUE | | | LIGHT RESISTANCE F [%] EXCELLENT: 70% OR OVER | SUBLIMATION RESISTANCE Sr [%] EXCELLENT: 98% OR OVER | TONER IMAGE AFTER THERMOCOMPRESSION BONDING TRANSFER MEASUREMENT b* VALUE | MELT VISCOSITY η [Pa·s] |
|---|---|---|---|---|---|---|---|---|---|
| | | | L* | a* | b* | | | | |
| EXAMPLE E11 | T11 | 80:20 | 92.7 | -8.5 | 93.4 | 86.7% | 101% | 1.8 | 1600 |
| EXAMPLE E12 | T12 | 80:20 | 92.6 | -8.6 | 95.4 | 86.2% | 100% | 2.9 | 1400 |
| EXAMPLE E13 | T13 | 80:20 | 92.8 | -7.9 | 93.8 | 85.5% | 100% | 0.8 | 1600 |
| EXAMPLE E14 | T14 | 76.5:23.5 | 92.7 | -8.2 | 94.4 | 85.4% | 100% | 1.4 | 1400 |
| EXAMPLE E15 | T15 | 73:27 | 92.9 | -8.6 | 95.2 | 85.5% | 100% | 0.9 | 1600 |
| COMPARATIVE EXAMPLE C11 | T16 | - | 91.9 | -7.9 | 97.9 | 53.5% | 90% | 28.2 | 1800 |
| COMPARATIVE EXAMPLE C12 | T17 | 100:0 | 92.4 | -7.0 | 90.6 | 88.6% | 100% | 2.5 | 2160 |
| COMPARATIVE EXAMPLE C13 | T18 | 80:20 | 92.9 | -8.2 | 93.5 | 86.8% | 101% | 0.7 | 2100 |

FIG.22

TABLE 4

| EXAMPLE/ COMPARATIVE EXAMPLE | YELLOW TONER | MELT VISCOSITY η [Pa·s] | RED 200% DENSITY IMAGE (YELLOW 100% DENSITY + MAGENTA 100% DENSITY) VISUAL CHECK JUDGMENT | RED 200% DENSITY IMAGE PRINT HUE | | | | HUE OVERALL JUDGMENT |
|---|---|---|---|---|---|---|---|---|
| | | | | L* | a* | b* | QUALITY JUDGMENT FIG. 24 | |
| EXAMPLE E11 | T11 | 1600 | EXCELLENT | 48.7 | 63.2 | 47 1 | EXCELLENT | EXCELLENT |
| EXAMPLE E12 | T12 | 1400 | EXCELLENT | 49.0 | 63.6 | 47.3 | EXCELLENT | EXCELLENT |
| EXAMPLE E13 | T13 | 1600 | EXCELLENT | 50.0 | 62.5 | 48.1 | EXCELLENT | EXCELLENT |
| EXAMPLE E14 | T14 | 1500 | EXCELLENT | 49.3 | 62.9 | 48.1 | EXCELLENT | EXCELLENT |
| EXAMPLE E15 | T15 | 1500 | EXCELLENT | 48.6 | 63.3 | 48.2 | EXCELLENT | EXCELLENT |
| COMPARATIVE EXAMPLE C11 | T16 | 1800 | EXCELLENT | 47.4 | 59.6 | 45.1 | EXCELLENT | EXCELLENT |
| COMPARATIVE EXAMPLE C12 | T17 | 2160 | INFERIOR | 48.4 | 59.6 | 45.1 | INFERIOR | INFERIOR |
| COMPARATIVE EXAMPLE C13 | T18 | 2100 | INFERIOR | 48.7 | 63.1 | 45.3 | INFERIOR | INFERIOR |

TONER, TONER CARTRIDGE, DEVELOPMENT DEVICE, AND IMAGE FORMING APPARATUS

CROSS-REFERENCE TO RELATED APPLICATION

This application claims priority under 35 U.S.C. § 119(b) to Japanese Application No. 2017-229772, filed Nov. 30, 2017 and Japanese Application No. 2018-136292, filed Jul. 20, 2018, the disclosures of which are incorporated herein by reference in their entirety.

BACKGROUND OF THE INVENTION

1. Field of the Invention

The present invention relates to a toner as a developing agent, and a toner cartridge, a development device and an image forming apparatus containing the toner.

2. Description of the Related Art

In order to improve the quality of a print image (toner image) formed on a sheet by an image forming apparatus employing an electrophotographic process, there has been a proposal specifying melt viscosity and a ratio of a toner to be used. See Japanese Patent Application Publication No. 2015-68889 (in particular, claims 1 to 3), for example.

However, it is sometimes impossible to maintain the quality of print images at a high level just by specifying the melt viscosity and the ratio of the toner. For example, even when the color tone of a print image just after the printing is excellent, colors of the print image can fade away due to chronological change (i.e., light resistance is insufficient). Further, when the printing is performed in consideration of the chronological change in the color tone of the print image, there are cases where the color tone of the print image just after the printing is inappropriate. Incidentally, the color tone means a detailed tone of color, such as subtle gradation of color, subtle deviation in color, and so forth.

SUMMARY OF THE INVENTION

The object of the present invention is to provide a toner that makes it possible to form a print image having an excellent color tone and excelling in the light resistance, and a toner cartridge, a development device and an image forming apparatus containing the toner.

A toner according to the present invention includes binder resin; and a coloring agent provided in the hinder resin. The coloring agent is configured so that hue of a hue measurement print image printed on a print medium with the toner satisfies $$-8.6 \leq a^*(Y) \leq -7.9 \text{ and } 93.4 \leq b^*(Y) \leq 95.4$$

where a*(Y) and b*(Y) respectively represent an a* value and a b* value of the hue measurement print image in an L*a*b* color model, light resistance F of a light resistance measurement print image printed on a print medium with the toner, after an irradiation test in which the light resistance measurement print image is irradiated with light having 0.36 W/m$^2$ spectral irradiance at a wavelength of 340 nm for 663 hours satisfies $$F \geq 70\%, \text{ and}$$

the light resistance F is obtained as $$F\ (\%) = (D(E)/D(S)) \times 100(\%)$$

where D(E) represents optical density of a 100% density image with the toner after the irradiation test and D(S) represents optical density of the 100% density image with the toner before the irradiation test. Furthermore, the toner is configured so that melt viscosity η of the toner at 120° C. satisfies $$1400\ (\text{Pa·s}) \leq \eta \leq 1600\ (\text{Pa·s}).$$

According to the present invention, a print image having an excellent color tone and excelling in the light resistance can be formed.

BRIEF DESCRIPTION OF THE DRAWINGS

In the accompanying drawings:

FIG. 14 is a diagram showing a result of measurement of pigment ratio, print hue, light resistance, sublimation resistance, a b* value of a yellow 100% (also referred to as "Y100%")density image after thermocompression bonding transfer measurement, and melt viscosity of yellow toners T11 to T15 in examples E11 to E15 as toners according to a third embodiment and yellow toners T16 to T18 in comparative examples C11 to C13, as a table;

FIG. 22 is a diagram showing a result of an evaluation test performed by using the yellow toners T11 to T18 in the examples E11 to E15 and the comparative examples C11 to C13 to check the effect of the toners according to the third embodiment as Table 4;

DETAILED DESCRIPTION OF THE INVENTION

A toner, a toner cartridge, a development device and an image forming apparatus according to embodiments of the present invention will be described below with reference to the accompanying drawings. In a first embodiment, a description will be given of an image forming apparatus using a toner according to the embodiment, a development device as a development means constituting a part of the image forming apparatus, and a toner cartridge that can be attached to the development device. In second and third embodiments, a description will be given of toners as developing agents employing the present invention. However, the following embodiments are just examples for illustration and a variety of modifications are possible within the scope of the present invention.

(1) First Embodiment

Figure 1:
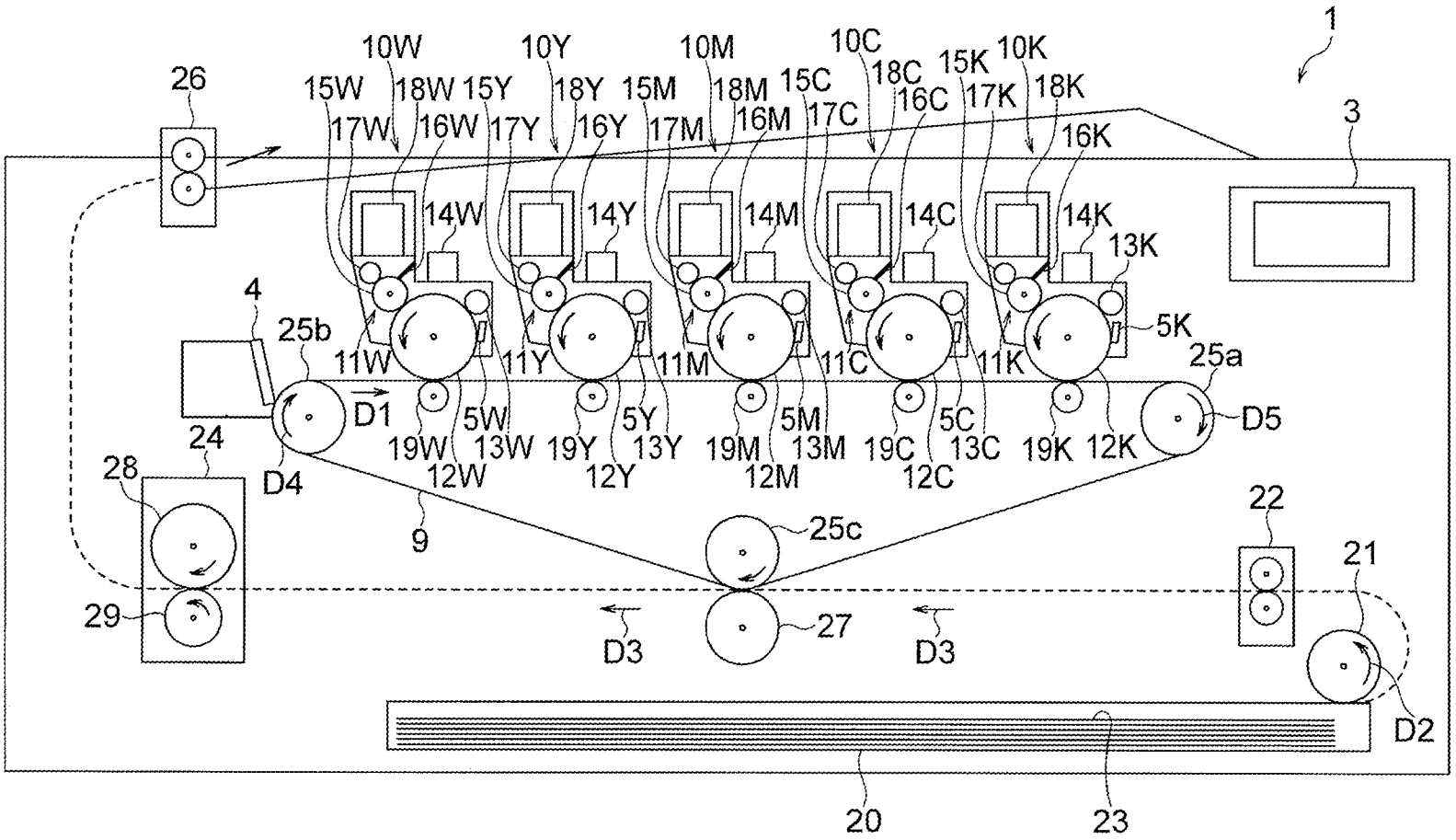
FIG. 1 is a vertical sectional view schematically showing an internal configuration of an image foiling apparatus according to a first embodiment of the present invention.

FIG. 1 is a vertical sectional view schematically showing an internal configuration of an image forming apparatus 1 according to the first embodiment of the present invention. The image forming apparatus 1 is a color printer of the intermediate transfer type that forms toner images of white (W), yellow (Y), magenta (M), cyan (C) and black (K) on an intermediate transfer belt 9 by an electrophotographic process (primary transfer) and secondarily transfers these toner images from the intermediate transfer belt 9 onto a sheet 23 as a print medium.

The image forming apparatus 1 includes image forming sections 10W, 10Y, 10M, 10C and 10K as image forming means arranged in series in a moving direction D1 in a part over the intermediate transfer belt 9. The image forming sections 10W, 10Y, 10M, 10C and 10K respectively form toner images according to image data by using a white (W) toner, a yellow (Y) toner, a magenta (M) toner, a cyan (C) toner and a black (K) toner. Each image forming section 10W, 10Y, 10M, 10C, 10K can be provided as an exchangeable unit structure to be detachably mounted on a main body of the apparatus. The yellow toner contained in a development device 11Y of the image forming section 10Y or contained in a toner cartridge attached to the development device 11Y is a toner according to the second or third embodiment of the present invention. Incidentally, the white toner, the magenta toner, the cyan toner and the black toner contained in development devices 11W, 11M, 11C and 11K of the image forming sections 10W, 10M, 10C and 10K or contained in toner cartridges attached to the development devices 11W, 11M, 11C and 11K are genuine toners of an ordinary (commercially available) type.

Each image forming section 10W, 10Y, 10M, 10C, 10K includes a photosensitive drum 12W, 12Y, 12M, 12C, 12K as an image bearing body on whose surface an electrostatic latent image is formed and a charging roller 13W, 13Y, 13M, 13C, 13K as a charging device or charging means for uniformly charging the surface of the photosensitive drum 12W, 12Y, 12M, 12C, 12K. Further, each image forming section 10W, 10Y, 10M, 10C, 10K includes an LED (Light-Emitting Diode) array head 14W, 14Y, 14M, 14C, 14K, as an exposure device or exposure means for forming the electrostatic latent image according to image data by applying light to the uniformly charged surface of the photosensitive drum 12W, 12Y, 12M, 12C, 12K, and a cleaning blade 5W, 5Y, 5M, 5C, 5K. Incidentally, it is also possible to provide each LED array head 14W, 14Y, 14M, 14C, 14K not as a part of the image forming section 10W, 10Y, 10M, 10C, 10K provided as an exchangeable unit structure but as a component fixed to the main body of the apparatus.

Each photosensitive drum 12W, 12Y, 12M, 12C, 12K includes an electrically conductive support body in a cylindrical shape and a photosensitive layer part made of a photosensitive layer applied on a surface of the electrically conductive support body. The photosensitive layer part includes a blocking layer, a charge generation layer and a charge transport layer that are stacked in layers. The charge transport layer has been applied up to a thickness of approximately 18 μm, for example. The film thickness is measured by using an eddy current film thickness meter "LH-200J" produced by Kett Electric Laboratory, for example.

Each image forming section 10W, 10Y, 10M, 10C, 10K includes the development device 11W, 11Y, 11M, 11C, 11K as the development means for supplying the white toner, the yellow toner, the magenta toner, the cyan toner or the black toner to the surface of the photosensitive drum 12W, 12Y, 12M, 12C, 12K. Each development device 11W, 11Y, 11M, 11C, 11K includes a development roller 15W, 15Y, 15M, 15C, 15K as a developing agent bearing body, a supply roller 17W, 17Y, 17M, 17C, 17K, a development blade 16W, 16Y, 16M, 16C, 16K for regulating a thickness of the toner on the development roller 15W, 15Y, 15M, 15C, 15K, and a toner storage part 18W, 18Y, 18M, 18C, 18K as a container for storing the white toner, the yellow toner, the magenta toner, the cyan toner or the black toner. Each toner storage part 18W, 18Y, 18M, 18C, 18K includes a toner cartridge that can be attached to the development device 11W, 11Y, 11M, 11C, 11K.

Each development roller 15W, 15Y, 15M, 15C, 15K includes a shaft made of metal and an elastic body provided on the periphery of the shaft. The elastic body is semiconductive urethane rubber at rubber hardness of 70° (ASKER C), for example. Each supply roller 17W, 17Y, 17M, 17C, 17K includes a shaft made of metal and a foam body provided on the periphery of the shaft. The foam body is silicone foam at hardness of 50° (ASKER F), for example.

The image forming apparatus 1 includes a sheet cassette 20 in which unused sheets 23 are stacked up, a sheet feed roller 21 for extracting the sheets 23 from the sheet cassette 20 sheet by sheet by rotating in a direction of an arrow D2, and conveyance rollers 22 for conveying the sheet 23 in a direction of an arrow D3. Further, the image forming apparatus 1 includes the intermediate transfer belt 9 in an endless shape moving in a direction of an arrow D1, drive rollers 25*a* and 25*b* for driving the intermediate transfer belt 9, a driven roller 25*c* for supporting the intermediate transfer belt 9, and a cleaning blade 4 for removing the toners remaining on the surface of the intermediate transfer belt 9. Furthermore, the image forming apparatus 1 includes transfer rollers 19W, 19Y, 19M, 19C and 19K for transferring the toner image of the white toner, the toner image of the yellow toner, the toner image of the magenta toner, the toner image of the cyan toner and the toner image of the black toner respectively formed on the surfaces of the photosensitive drums 12W, 12Y, 12M, 12C and 12K onto the intermediate transfer belt 9 (primary transfer) and a transfer roller 27, as a transfer unit or transfer means for transferring the toner images formed on the intermediate transfer belt 9 onto the sheet 23 as the print medium (secondary transfer). Moreover, the image forming apparatus 1 includes a fixing unit 24, as a fixing means including a heating roller 28 having a heating element such as a halogen lamp and a pressure roller 29, and an ejection roller unit 26 for ejecting the sheet 23 after passing through the fixing unit 24 to the outside of the apparatus.

Figure 2:
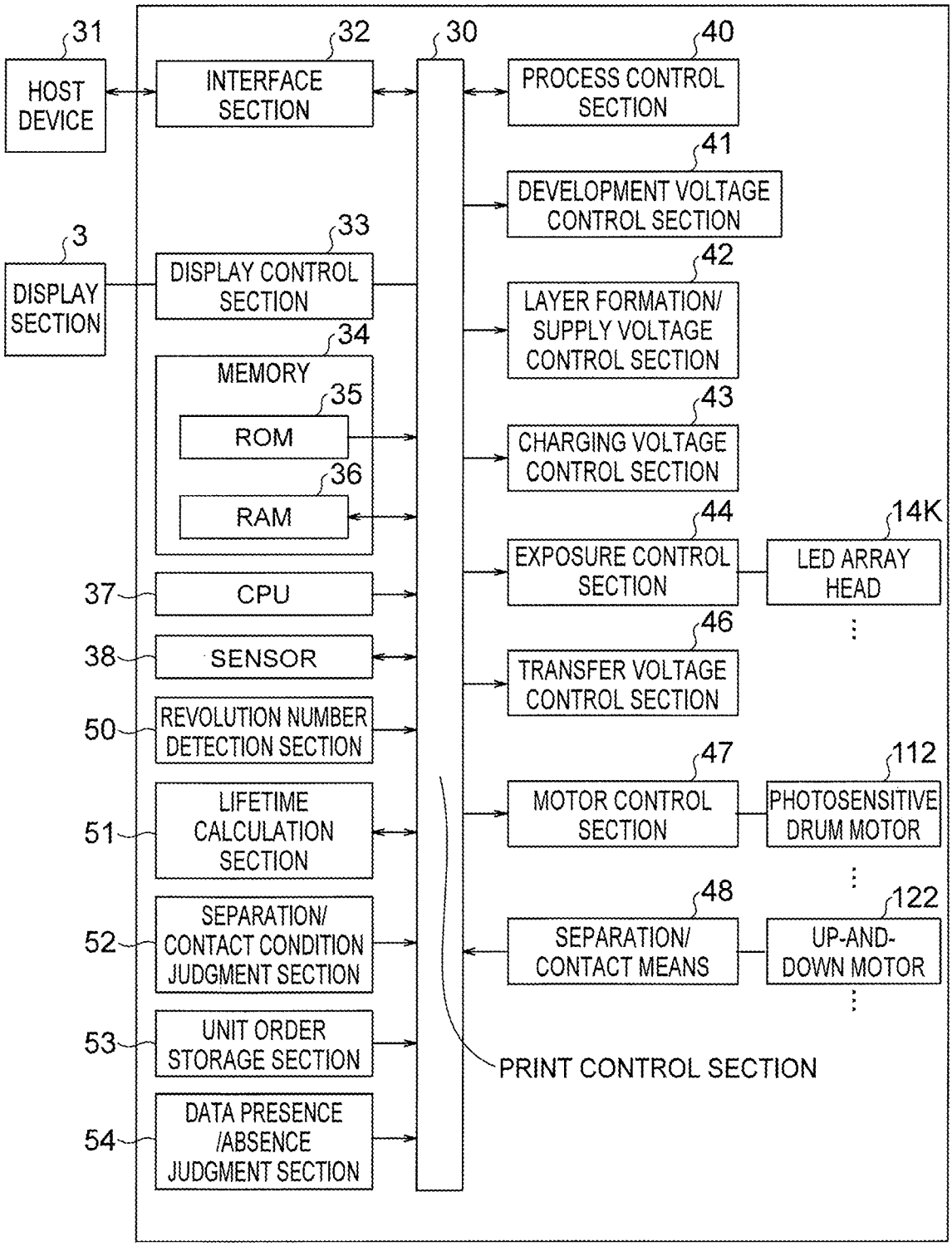
FIG. 2 is a block diagram schematically showing a configuration of a control system of the image forming apparatus according to the first embodiment.

FIG. 2 is a block diagram schematically showing a configuration of a control system of the image forming apparatus 1 according to the first embodiment. As shown in FIG. 2, the image forming apparatus 1 includes a print control section 30 as a control means for controlling operation of the whole of the apparatus, an interface section 32, a display control section 33, and a memory 34. The interface section 32 receives print data transmitted from a host device 31 (e.g., computer) serving as an information input means and supplies the print data to the print control section 30. The display control section 33 controls a display state of a display section 3 according to a command signal from the print control section 30. The memory 34 includes a ROM (Read Only Memory) 35 as a nonvolatile storage device for storing information indicating procedures of print operation and a variety of information such as calculation formulas for making various corrections (e.g., software program) and a RAM (Random Access Memory) 36 as a volatile storage device.

Further, the image forming apparatus 1 includes various types of sensors 38 for detecting a position of the sheet 23, temperature, humidity, and so forth, a CPU (Central Processing Unit) 37, a process control section 40 for controlling a voltage of each section such as the image forming sections 10W, 10Y, 10M, 10C and 10K, a development voltage control section 41, a layer formation/supply voltage control section 42, a charging voltage control section 43, an exposure control section 44, a transfer voltage control section 46, and a motor control section 47. The development voltage control section 41 controls voltages of the development rollers 15W, 15Y, 15M, 15C and 15K. The layer formation/supply voltage control section 42 controls voltages of the supply rollers 17W, 17Y, 17M, 17C and 17K and the development blades 16W, 16Y, 16M, 16C and 16K. The charging voltage control section 43 controls voltages of the charging rollers 13W, 13Y, 13M, 13C and 13K. The transfer voltage control section 46 controls voltages of the transfer rollers 19W, 19Y, 19M, 19C and 19K and the transfer roller 27. The exposure control section 44 controls lighting and extinction of LEDs of the LED array heads 14W, 14Y, 14M, 14C and 14K.

The motor control section 47 includes a photosensitive drum motor control section (not shown) for controlling a photosensitive drum motor 112. The motor control section 47 rotates the photosensitive drums 12W, 12Y, 12M, 12C and 12K in a predetermined direction by controlling the photosensitive drum motor 112 via the photosensitive drum motor control section. In each image forming section, the photosensitive drum 12W, 12Y, 12M, 12C, 12K, the development roller 15W, 15Y, 15M, 15C, 15K and the supply roller 17W, 17Y, 17M, 17C, 17K are connected together by a drive force transmission mechanism such as one or more gears, and the development roller 15W, 15Y, 15M, 15C, 15K and the supply roller 17W, 17Y, 17M, 17C, 17K rotate in conjunction with the rotation of the photosensitive drum 12W, 12Y, 12M, 12C, 12K. Further, the motor control section 47 rotates the drive rollers 25*a* and 25*b* for the intermediate transfer belt 9 by controlling a transfer belt drive motor (not shown). Furthermore, the motor control section 47 rotates the sheet feed roller 21 by controlling a sheet feed motor (not shown).

Further, the image forming apparatus 1 includes a separation/contact means 48 as a separation/contact mechanism, a separation/contact condition judgment section 52, an up-and-down motor 122, a revolution number detection section 50, and a lifetime calculation section 51. The separation/contact means 48 makes each image forming section 10W, 10Y, 10M, 10C, 10K separate from or contact the intermediate transfer belt 9 by driving the up-and-down motor 122 to move an up-and-down link lever. The revolution number detection section 50 detects a cumulative number of revolutions of each photosensitive drum 12W, 121, 12M, 12C, 12K. The lifetime calculation section 51 calculates a remaining number of revolutions of each photosensitive drum 12W, 12Y, 12M, 12C, 12K before expiration of the lifetime of the photosensitive drum 12W, 12Y, 12M, 12C, 12K.

The separation/contact condition judgment section 52 judges a separation/contact condition of each image forming section 10W, 10Y, 10M, 10C, 10K based on a rotational condition of the photosensitive drum 12W, 12Y, 12M, 12C, 12K. When the image forming section 10W has no image data of an electrostatic latent image for the white toner, the image forming section 10W remains separate from the intermediate transfer belt 9 and no rotational drive force is transmitted to the photosensitive drum 12W.

Furthermore, the image forming apparatus 1 includes a unit order storage section 53 and a data presence/absence judgment section 54. The unit order storage section 53 stores the order of arrangement of the image forming sections 10W, 10Y, 10M, 10C and 10K. The data presence/absence judgment section 54 judges whether image data to be printed by each image forming section 10W, 10Y, 10M, 10C, 10K exists or not by analyzing print data transmitted from the host device 31 and received by the interface section 32.

The print control section 30 commands the motor control section 47 to rotate the photosensitive drums 12W, 12Y, 12M, 12C and 12K as the image bearing bodies by using the photosensitive drum motor 112 via the photosensitive drum motor control section. At the same time, the development rollers 15W, 15Y, 15M, 15C and 15K and the supply rollers 17W, 17Y, 17M, 17C and 17K are rotated.

The print control section 30 commands the development voltage control section 41 to apply voltages to the development rollers 15W, 15Y, 15M, 15C and 15K, commands the layer formation/supply voltage control section 42 to apply voltages to the supply rollers 17W, 17Y, 17M, 17C and 17K and the development blades 16W, 16Y, 16M, 16C and 16K, and commands the charging voltage control section 43 to apply voltages to the charging rollers 13W, 13Y, 13M, 13C and 13K. When each photosensitive drum 12W, 12Y, 12M, 12C, 12K rotates, the charging roller 13W, 13Y, 13M, 13C, 13K rotates accompanying the rotation of the photosensitive drum 12W, 12Y, 12M, 12C, 12K and the surface of the photosensitive drum 12W, 12Y, 12M, 12C, 12K is charged.

After the surfaces of the photosensitive drums 12W, 12Y, 12M, 12C and 12K have been charged uniformly, the print control section 30 commands the exposure control section 44 to form electrostatic latent images according to image data on the surfaces of the photosensitive drums 12W, 12Y, 12M, 12C and 12K with the LED array heads 14W, 14Y, 14M, 14C and 14K.

After the electrostatic latent image has been formed on the surface of each photosensitive drum 12W, 12Y, 12M, 12C, 12K, the electrostatic latent image on the surface of the photosensitive drum 12W, 12Y, 12M, 12C, 12K is developed with the toner on the surface of the development roller 15W, 15Y, 15M, 15C, 15K.

Meanwhile, the print control section 30 commands the motor control section 47 to rotate the drive rollers 25*a* and 25*b* for the intermediate transfer belt 9 in a direction of an arrow D4 and a direction of an arrow D5 by using the transfer belt drive motor. The rotation of the drive rollers 25*a* and 25*b* causes the intermediate transfer belt 9 to move and rotate. Then, the print control section 30 commands the motor control section 47 to feed a sheet 23 with the sheet feed roller 21 by using the sheet feed motor. The sheet 23 after being fed by the sheet feed roller 21 rotating in the direction of the arrow D2 is pressed between the conveyance rollers 22 and conveyed in the direction of the arrow D3.

The sheet 23 onto which the toner images have been transferred is heated and pressed by the fixing unit 24, by which the toner images are fixed on the sheet 23. The sheet 23 is ejected by the ejection roller unit 26 to the outside of the apparatus through an ejection port.

The image forming apparatus 1, the development device 11Y and the toner cartridge according to the first embodiment include the toner according to the second or third embodiment as the yellow toner. In cases where the image forming apparatus 1 according to the first embodiment includes the toner according to the second embodiment, a print image having an excellent color tone and excelling in the light resistance can be formed. In cases where the image forming apparatus 1 according to the first embodiment includes the toner according to the third embodiment, a print image having an excellent color tone, excelling in the light resistance, and excelling in sublimation resistance can be formed.

(2) Second Embodiment (2-1) Toner According to Second Embodiment

Figure 3:
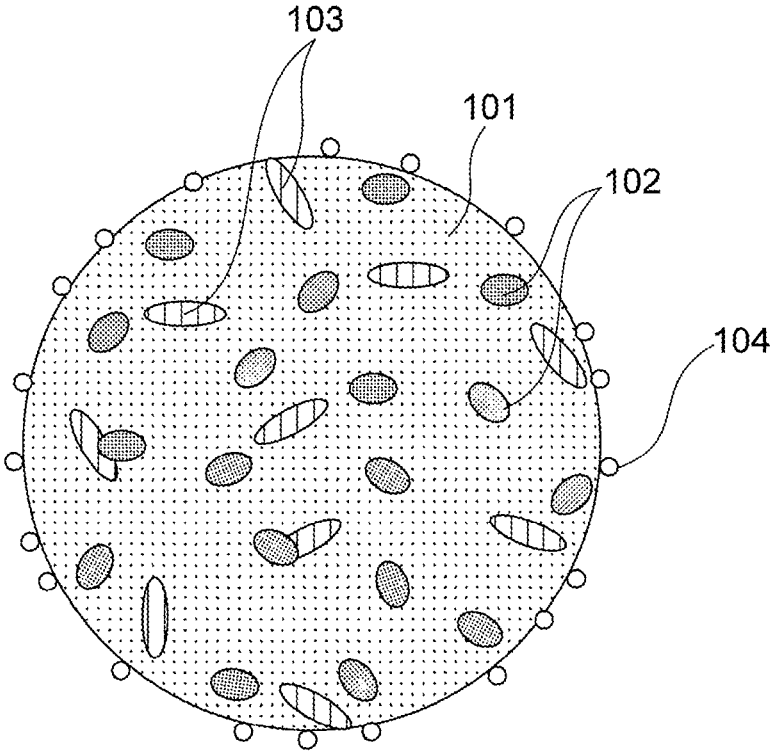
FIG. 3 is a cross-sectional view schematically showing a configuration of a toner according to a second embodiment of the present invention.

FIG. 3 is a cross-sectional view schematically showing a particle of the toner according to the second embodiment of the present invention. The toner according to the second embodiment is a nonmagnetic monocomponent yellow toner. The toner according to the second embodiment is stored in the image forming apparatus 1 according to the first embodiment, the development device 11Y, and a toner cartridge (toner storage part 18Y in FIG. 1) attached to the development device 11Y. The toner according to the second embodiment includes binder resin 101 having a particulate shape such as styrene acryl and a coloring agent (color material) 102 provided (dispersed) in the binder resin 101. Further, the toner according to the second embodiment may include wax 103 provided (dispersed) in the binder resin 101 and an external additive 104 such as silica or titanium oxide adhering to the surface of the coloring resin particle as the binder resin 101 in which the coloring agent 102 is provided. Furthermore, the toner according to the second embodiment may include a charge control agent as an additive for controlling the polarity and the electrification amount of the toner electrically charged.

The coloring agent 102 includes one or more types of yellow pigment. The coloring agent 102 in the toner according to the second embodiment is configured so that the print hue of a hue measurement print image (yellow 100% density image shown in FIG. 8) as a toner image printed on a sheet as the print medium by the image forming apparatus 1 according to the first embodiment satisfies both of the following conditions (1) and (2): In other words, for the coloring agent 102 in the toner according to the second embodiment, the type, amount, compounding ratio, etc. of the pigment constituting a part of the coloring agent 102 are determined so that the print hue of the hue measurement print image satisfies both of the following conditions (1) and (2):

$$-8.6 \leq a^*(Y) \leq -7.9 \quad (1)$$

$$93.4 \leq b^*(Y) \leq 95.4 \quad (2)$$

where a*(Y) and b*(Y) represent the a* value and the b* value of the hue measurement print image in the CIE1976 (L*, a*, b*) color space, that is, the L*a*b* color model.

Further, the toner according to the second embodiment is configured so that the melt viscosity η (Pa·s (pascal second)) of the toner at 120° C. satisfies the following condition (3): In other words, for the toner according to the second embodiment, the type and molecular weight of the resin used as the binder resin 101 and the types, amounts, compounding ratios, etc. of other components are determined to satisfy the following condition (3):

$$1400\ (\text{Pa}\cdot\text{s}) \leq \eta \leq 1600\ (\text{Pa}\cdot\text{s}) \quad (3)$$

Furthermore, the coloring agent 102 of the toner according to the second embodiment is desired to be configured so that the light resistance F (%) of a light resistance measurement print image as a toner image printed on a sheet as the print medium by the image forming apparatus 1 according to the first embodiment, after being irradiated with light having 0.36 W/m$^2$ spectral irradiance at a wavelength of 340 nm for 663 hours (i.e., after an irradiation test), satisfies the following condition (4): In other words, the type, amount, compounding ratio, etc. of the pigment constituting a part of the coloring agent 102 are desired to be determined to satisfy the following condition (4):

$$F \geq 70\% \quad (4)$$

The light resistance F (%) is calculated by use of the following expression using a survival rate of the optical density (O.D.):

$$F\ (\%)=(D(E)/D(S))\times 100(\%)$$

where D(E) represents the O.D. of the yellow 100% density image after the irradiation test and D(S) represents the O.D. of the yellow 100% density image before the irradiation test.

Namely, the light resistance F (%) is percentage representation of a value obtained by dividing second optical density as the optical density of the light resistance measurement print image with the toner after the irradiation test by first optical density as the optical density of the light resistance measurement print image with the toner before the irradiation test.

Figure 4:
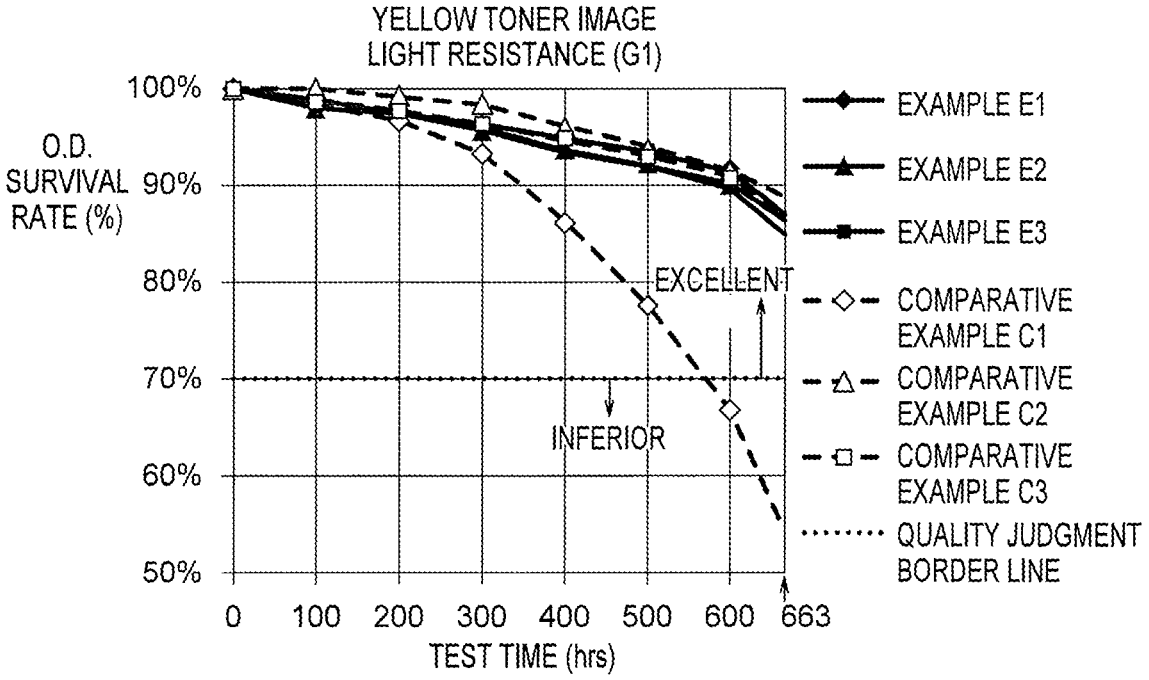
FIG. 4 is a diagram showing a result of a light resistance test of print images formed with yellow toners (examples E1 to E3) as toners according to the second embodiment and print images formed with yellow toners in comparative examples (comparative examples C1 to C3) as a graph G1.
Figure 5:
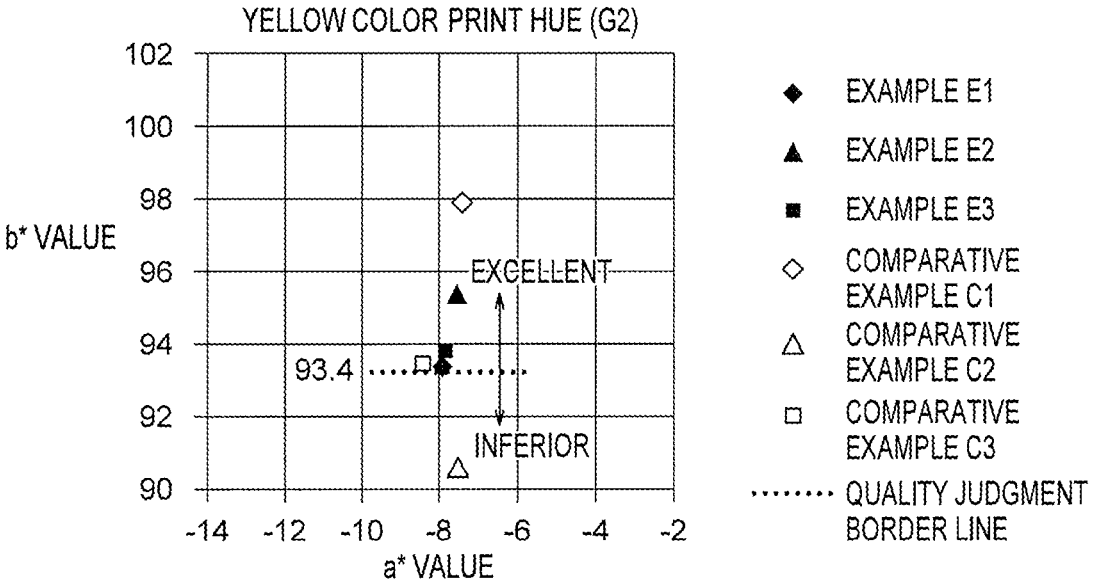
FIG. 5 is a diagram showing a result of measurement of print hue of print images formed with the yellow toners (examples E1 to E3) as the toners according to the second embodiment and print images formed with the yellow toners in the comparative examples (comparative examples C1 to C3) as a graph G2 in the L*a*b* color model.

The basis of upper limits and lower limits in the above conditions (1) to (4) in regard to the toner (yellow toner) according to the second embodiment will be described later with reference to Table 1, FIG. 4 and FIG. 5 showing the result of evaluation tests performed on yellow toners T1 to T3 in examples E1 to E3 as toners according to the second embodiment and yellow toners T4 to T6 in comparative examples C1 to C3.

Further, evaluation of a red image (compound color image) in a case where the red image is printed by using the toner (yellow toner) according to the second embodiment and a conventional magenta toner will be described later with reference to Table 2 and FIGS. 6 to 13.

Print images formed by use of the toner according to the second embodiment have excellent color tones and excel in the light resistance.

(2-2) Manufacturing Process of Toner According to Second Embodiment

The toner according to the second embodiment is manufactured by the following manufacturing process using emulsion polymerization, for example:

(Preparation Step)

Styrene-acrylic copolymer resin as binder resin (101 in FIG. 3) and a coloring agent (102 in FIG. 3) are prepared, and wax (103 in FIG. 3), an external additive (104 in FIG. 3) and a charge control agent are also prepared as needed.

The styrene-acrylic copolymer resin can be produced from styrene, acrylic acid and methyl methacrylate.

The coloring agent is a mixture of C.I. Pigment Yellow 155 and C.I. Pigment Yellow 185 as yellow pigments at a ratio of 4:1. C.I. is an abbreviation of Color Index International.

The wax is paraffin wax.

The external additive is silica, including hydrophobic silica fine powder whose average particle diameter is 8 nm to 20 nm (hereinafter also referred to as "small silica"), hydrophobic silica fine powder whose average particle diameter is 20 nm to 80 nm (hereinafter also referred to as "large silica"), and colloidal silica fine powder whose average particle diameter is 80 nm to 140 nm (hereinafter also referred to as "colloidal silica"), for example. The small silica is "Aerosil 8972" or "Aerosil R974" produced by Nippon Aerosil Co., Ltd., for example. The large silica is "Aerosil RX50" or "Aerosil VP RX 40S" produced by Nippon Aerosil Co., Ltd., for example. The colloidal silica is sol-gel spherical silica particles "X-24-9163A" or "X-24-9600A-80" produced by Shin-Etsu Chemical Co., Ltd., for example.

(Coloring Resin Particle Formation Step)

Subsequently, the styrene-acrylic copolymer resin and the coloring agent, together with the wax and the charge control agent as needed, are mixed together by using emulsion polymerization, and the coloring resin particles are generated by cohesion.

In the emulsion polymerization, primary particles are made by dispersing a resin monomer in a solvent including an emulsifier, a polymerization initiator and water, the coloring agent emulsified by an emulsifier (surfactant) is mixed into the solvent including the primary particles, while also adding the wax, the charge control agent, etc. into the solvent as needed, and the coloring resin particles are generated in the solvent by cohesion of these materials. The coloring resin particles are extracted from the solvent, unnecessary solvent components and by-product components are removed by rinsing and drying, by which the coloring resin particles are obtained.

(External Additive Adhesion Step)

Subsequently, the silica as the external additive is mixed into the coloring resin particles by using a mixer, by which a nonmagnetic monocomponent toner like the one shown in FIG. 3 is manufactured. As the mixer, Hensel Mixer produced by Mitsui Mining Company Limited can be used.

(2-3) Evaluation Test of Toner According to Second Embodiment (2-3-1) Outline of Evaluation Test of Yellow Toner The yellow toners T1 to T3 in the examples E1 to E3 were manufactured as the toners according to the second embodiment. Further, the yellow toners T4 to T6 in the comparative examples C1 to C3 were manufactured.

The evaluation test was performed on these yellow toners T1 to T6. In the evaluation test, the yellow 100% density images of the yellow toners T1 to T6 were printed on a white paper medium (sheet), the L* value, the a* value and the b* value in the L*a*b* color model were measured as the print hue, the optical density (O.D.) in the aforementioned calculation formula of the light resistance F (%) was measured, and the light resistance F (%) was calculated from the D.D.

Further, in the evaluation test, the melt viscosity η (Pa·s) of each of the yellow toners T1 to T6 was measured.

(2-3-2) Measurement of Hue (Print Hue) of Yellow Toner Print Image (Measuring Instrument)

For the measurement of the L* value, the a* value and the b* value representing the print hue in the L*a*b* color model, a measuring instrument "X-Rite528" (produced by X-Rite Inc.) as a colorimeter/densitometer was used.

(Underlay for Print Medium)

In the measurement of print hue by use of the measuring instrument "X-Rite528", a white paper medium (i.e., white paper) was used as an underlay (black packing) for the print medium. Specifically, an underlay made by stacking five sheets of white paper satisfying the following conditions was used as the underlay for the print medium:

$$96.3 \le L^*(W) \le 96.8,$$

$$1.7 \le a^*(W) \le 2.0, \text{ and}$$

$$-5.6 \le b^*(W) \le -5.2$$

where L*(W), a*(W) and b*(W) respectively represent the L* value, the a* value and the b* value in the L*a*b* color model. As the white paper, paper "Excellent White A4 (70 kg paper)" (produced by Oki Data Corporation) was used.

(Setting of Measuring Instrument)

For the measurement of print hue of the print images with the yellow toners T1 to T6, measurement conditions in the measuring instrument "X-Rite528" were set as follows:

A measurement mode was set at "measurement mode by L*a*b* color model", an observation light source (illuminant) was set at "D50" (light source at color temperature of approximately 5000 K), and a viewing angle (observation field) was set at "2°".

(Measurement)

The hue of the print obtained on the print medium by using each of the yellow toners T1 to T6 was measured by use of the measuring instrument "X-Rite528" with the above-described settings.

(2-3-3) Measurement of Optical Density in Measurement of Hue of Yellow Toner (Measuring Instrument)

The optical density was employed as a parameter indicating the density of the toner print image. As a measuring instrument for measuring the optical density, the measuring instrument "X-Rite528" was used.

(Underlay for Print Medium)

In the measurement of optical density of the print images by use of the measuring instrument "X-Rite528", a black paper medium (i.e., black paper) was used as the underlay for the print medium. Specifically, black paper satisfying the following conditions was used as the underlay for the print medium:

$$25.1 \leq L^*(B) \leq 25.9,$$

$$0.2 \leq a^*(B) \leq 0.3, \text{ and}$$

$$0.5 \leq b^*(B) \leq 0.7$$

where L*(B), a*(B) and b*(B) respectively represent the L* value, the a* value and the b* value in the L*a*b* color model. As the black paper, "Colored Fine Quality Paper: Black" (produced by Hokuetsu Kishu Paper Co., Ltd.) was used.

(Setting of Measuring Instrument)

For the measurement of optical density of the print images with the yellow toners T1 to T6, measurement conditions in the measuring instrument "X-Rite528" were set as follows:

The measurement mode was set at "density measurement mode", a status setting was set at "status I", a white reference setting was set at "absolute white reference", and a filer setting was set at "no polarizing filter". The "status I" is a setting in regard to a wavelength range to be evaluated, which is stipulated in ISO5-3 "Photography and graphic technology—Density measurements"—Part 3: Spectral conditions.

(Measurement)

The optical density of each print was measured by use of the measuring instrument "X-Rite528" with the above-described settings. In the measuring instrument "X-Rite528", the optical density is obtained as four numerical values: a V value (Visual Value), a C value (Cyan Value), an M value (Magenta Value) and a Y value (Yellow Value). The Y value was used as the optical density of the yellow toners T1 to T6, the M value was used as the optical density of the magenta toner, and the C value was used as the optical density of the cyan toner.

(2-3-4) Measurement of Melt Viscosity of Yellow Toner

As a parameter indicating the melt viscosity of the toner, melt viscosity η (Pa·s) at 120° C. obtained from viscoelasticity measurement by use of a rotary rheometer was employed.

For the measurement of the melt viscosity η, a viscosity/viscoelasticity measurement device "HAAKE MARS III" produced by Thermo Fisher Scientific K.K. was used. In the measurement by use of "HAAKE MARS III", a temperature rise rate was set at 5° C./min, a frequency was set at 1 Hz, a gap was set at 1 mm, the yellow toners T1 to T6 were first melted sufficiently at a temperature of 140° C. by using a parallel plate having a ϕ20 mm diameter, thereafter the yellow toners T1 to T6 were heated from 50° C. to 230° C., and the melt viscosity η (Pa·s) when the yellow toners T1 to T6 were at 120° C. was obtained.

(2-3-5) Measurement of Optical Density for Calculating Light Resistance of Yellow Toner Print Image (Irradiation Test)

For the measurement of the light resistance F (%) of each yellow toner T1-T6, the survival rate (%) of the optical density (O.D.) of the toner image on the print, in a case where a light resistance test using a xenon arc lamp was performed on the print with the yellow toner T1-T6, was employed.

For the light resistance test using the xenon arc lamp, a xenon weather resistance test device (Weather-Ometer) "Ci4000" produced by ATLAS was used. In the measurement by use of "Ci4000", the spectral irradiance at 340 nm was set at 0.36 W/m$^2$, black panel temperature was set at 63° C., and an irradiation test for 663 hours was performed on a toner image at an optical density (O.D.) of 1.0 (yellow monochrome solid image) printed on Excellent White Paper produced by Oki Data Corporation, the optical density of the toner image after the irradiation test was measured, and the light resistance F (%) was obtained from the aforementioned calculation formula of the light resistance F (%).

(Measuring Instrument)

For the measurement of the optical density of the toner image in the measurement of light resistance, the measuring instrument "X-Rite528" (produced by X-Rite Inc.) was used.

(Underlay for Print Medium)

In the measurement of optical density by use of the measuring instrument "X-Rite528", the white paper medium (i.e., white paper) was used as the underlay for the print medium. Specifically, the underlay made by stacking five sheets of white paper satisfying the following conditions was used as the underlay for the print medium:

$$96.3 \leq L^*(W) \leq 96.8,$$

$$1.7 \leq a^*(W) \leq 2.0, \text{ and}$$

$$-5.6 \leq b^*(W) \leq -5.2$$

where L*(W), a*(W) and b*(W) respectively represent the L* value, the a* value and the b* value in the L*a*b* color model. As the white paper, the paper "Excellent White A4 (70 kg paper)" (produced by Oki Data Corporation) was used.

(Setting of Measuring Instrument)

For the measurement of optical density of the print images with the yellow toners T1 to T6, measurement conditions in the measuring instrument "X-Rite528" were set as follows: The measurement mode was set at "density measurement mode", the status setting was set at "status I", the white reference setting was set at "absolute white reference", and the filer setting was set at "no polarizing filter".

With the above-described settings, the optical density of the print obtained on the print medium by using each of the yellow toners T1 to T6 was measured by use of the measuring instrument "X-Rite528" at a plurality of time points in the irradiation test. In the measuring instrument "X-Rite528", the optical density is obtained as the four numerical values: the V value (Visual Value), the C value (Cyan Value), the M value (Magenta Value) and the Y value (Yellow Value), in which the Y value was used as the optical density of the yellow toners T1 to T6.

(Measurement)

The optical density of the print obtained on the print medium by using each of the yellow toners T1 to T6 was measured by use of the measuring instrument "X-Rite528" with the above-described settings.

(2-3-6) Result of Evaluation Test of Yellow Toner

Table 1 shows a result of the measurement of the print hue, the light resistance F (%), and the melt viscosity η (Pa·s) at 120° C. of the yellow toners T1 to T3 in the examples E1 to E3 as the toners according to the second embodiment and the yellow toners T4 to T6 in the comparative examples C1 to C3.

TABLE 1

| EXAMPLES E1-E3/ COMPARATIVE EXAMPLES | YELLOW | PRINT HUE | | | LIGHT RESISTANCE F [%] EXCELLENT: | MELT VISCOSITY |
|---|---|---|---|---|---|---|
| C1-C3 | TONER | L* | a* | b* | 70% OR OVER | η [Pa · s] |
| E1 | T1 | 92.7 | -8.5 | 93.4 | 87% | 1600 |
| E2 | T2 | 92.6 | -8.6 | 95.4 | 86% | 1400 |
| E3 | T3 | 92.8 | -7.9 | 93.8 | 85% | 1600 |
| C1 | T4 | 91.9 | −7.9 | 97.9 | 54% | 1800 |
| C2 | T5 | 92.4 | −7.0 | 90.6 | 89% | 2160 |
| C3 | T6 | 92.9 | −8.2 | 93.5 | 87% | 2100 |

The yellow toner T1 in the example E1 is an example of the toner according to the second embodiment. In the yellow toner T1, the coloring agent includes C.I. Pigment Yellow 155 and C.I. Pigment Yellow 185 at the ratio of 4:1. In the yellow toner T1, the melt viscosity η (Pa·s) at 120° C. is adjusted to 1600 (Pa·s) by lowering the molecular weight of the binder resin compared to that in an ordinary (commercially available) yellow toner (yellow toner T4 in the comparative example C1).

The yellow toner T2 in the example E2 is an example of the toner according to the second embodiment. In the yellow toner T2, the coloring agent includes C.I. Pigment Yellow 155 and C.I. Pigment Yellow 185 at the ratio of 4:1. In the yellow toner T2, the melt viscosity η (Pa·s) at 120° C. is adjusted to 1400 (Pa·s) by using binder resin differing in the molecular weight from the binder resin of the yellow toner T1.

The yellow toner T3 in the example E3 is an example of the toner according to the second embodiment. In the yellow toner T3, the coloring agent includes C.I. Pigment Yellow 155 and C.I. Pigment Yellow 185 at the ratio of 4:1. In the yellow toner T3, the melt viscosity η (Pa·s) at 120° C. is adjusted to 1600 (Pa·s) while using binder resin differing in the molecular weight from the binder resin of the yellow toner T1.

The yellow toner T4 in the comparative example C1 is an ordinary (commercially available) yellow toner. The yellow toner T4 is a yellow toner of a genuine yellow toner cartridge used for a color LED printer "C911dn" produced by Oki Data Corporation. The melt viscosity η of this yellow toner T4 at 120° C. is 1800 (Pa·s).

In the yellow toner T5 in the comparative example C2, the coloring agent is C.I. Pigment Yellow 155. In the yellow toner T5, the molecular weight of the binder resin is set equal to that in the yellow toner T4 in the comparative example C1. The melt viscosity η at 120° C. of the yellow toner T5 in the comparative example C2 configured as above is 2160 (Pa·s).

In the yellow toner T6 in the comparative example C3, the coloring agent is C.I. Pigment Yellow 155. In the yellow toner T6, the molecular weight of the binder resin is set equal to that in the yellow toner T4 in the comparative example C1. The melt viscosity η at 120° C. of the yellow toner. T6 in the comparative example C3 configured as above is 2100 (Pa·s).

In the yellow toners T1 to T3 in the examples E1 to E3, the pigments are selected so that the print hue satisfies both of the conditions (1) and (2).

The toner images with the yellow toners T1 to T3 in the examples E1 to E3 have excellent color tones equivalent to the color tone of the toner image with the conventional yellow toner T4 represented by the comparative example C1. Even these toner images (prints) having print hues different from each other look like they have color tones equivalent to each other, which can be attributed to the human eye lacking the ability to perceive a slight difference between yellow colors and recognizing such images as images of the same color tone.

Further, it has been known that the light resistance F (%) generally decreases as a pigment achieving a yellow print hue with a higher b* value in the yellow color is used in a yellow toner. Namely, the light resistance F (%) decreases with the increase in the b* value of the yellow toner. In the yellow toners T1 to T3 as the toners according to the second embodiment, the upper limit "95.4" of the b* value in the aforementioned condition (2) is a value for letting the toner have better light resistance than the conventional yellow toner T4 represented by the comparative example C1.

FIG. 4 is a diagram showing a result of the light resistance test of the print images formed with the yellow toners T1 to T3 (examples E1 to E3) according to the second embodiment and the print images formed with the yellow toners T4 to T6 in the comparative examples (examples C1 to C3) as a graph G1. FIG. 5 is a diagram showing a result of the measurement of print hue of the print images formed with the yellow toners T1 to T3 (examples E1 to E3) according to the second embodiment and the print images formed with the yellow toners T4 to T6 in the comparative examples (examples C1 to C3) as a graph G2 in the L*a*b* color model.

The yellow color print hue of the yellow toners T1 to T6 in the examples E1 to E3 and the comparative examples C1 to C3 was measured as indicated by the graph G2 shown in FIG. 5, and the light resistance F (%) of the toner images was measured as indicated by the graph G1 shown in FIG. 4. As is clear from FIG. 4 and FIG. 5, the light resistance F of the toner images with the yellow toners T1 to T3 in the examples E1 to E3 is excellent and the print hue of the toner images with the yellow toners T1 to T3 in the examples E1 to E3 is excellent.

Further, it has been known that the tendency of the toner to be consolidated when subjected to a high-pressure and high-humidity environment (e.g., temperature: 50° C., humidity: 55%) increases with the decrease in the melt viscosity at 120° C. The aforementioned high-pressure and high-humidity environment presumes the severest environment to which the toner can be subjected during transportation. If components of the yellow toners T1 to T3 in the examples E1 to E3 are changed to make a toner whose melt viscosity η at 120° C. is lower than 1400 (Pa·s), the toner cannot maintain sufficiently high viscosity due to the consolidation of the toner in the aforementioned severest environment. The lower limit 1400 (Pa·s) of the melt viscosity η in the aforementioned condition (3) is a lower limit for preventing the toner from falling into a state prone to consolidation.

As seen in Table 1 and FIG. 4 showing the result of the evaluation test using the yellow 100% density images with the yellow toners T1 to T6, the light resistance F (%) of the yellow toner T4 in the comparative example C1 is under 70% as the permissible value, whereas the light resistance F (%) of the other yellow toners T1 to T3, T5 and T6 is higher than or equal to the permissible value 70%.

Further, as seen in FIG. 5 showing the result of the evaluation test using the yellow 100% density images with the yellow toners T1 to T6, the b* value of the print hue of the yellow toner T5 in the comparative example C2 is under 93.4 as the lower limit, whereas the b* values of the print hue of the other yellow toners T1 to T4 and T6 are higher than or equal to the lower limit 93.4.

As above, from the evaluation test using the yellow 100% density images with the yellow toners T1 to T6, the yellow toners T1 to T3 and T6 can be judged to be excellent in the print hue and the light resistance.

Figure 6:
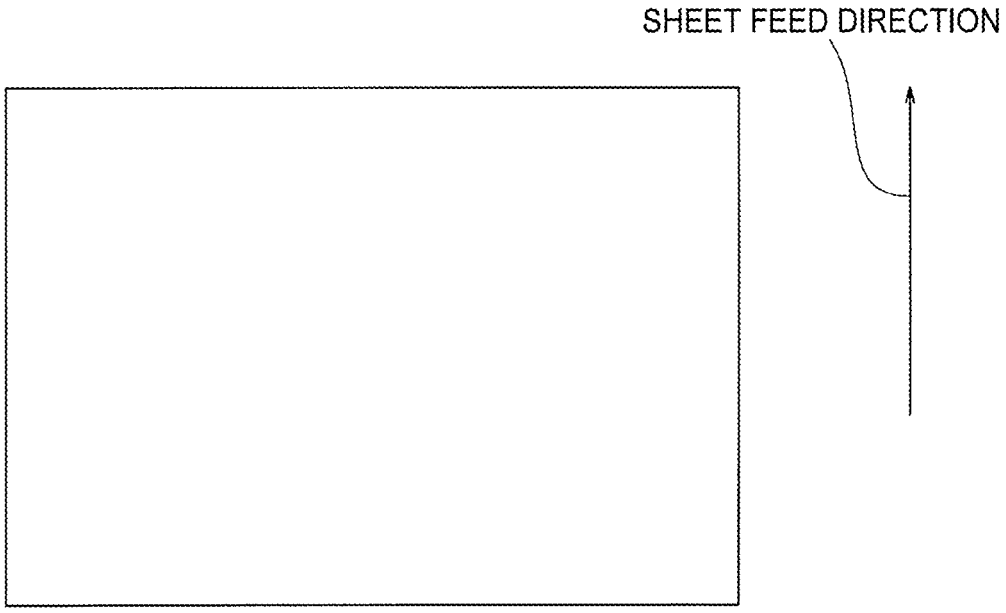
FIG. 6 is a plan view showing a sheet that has been undergone blank printing.
Figure 7:
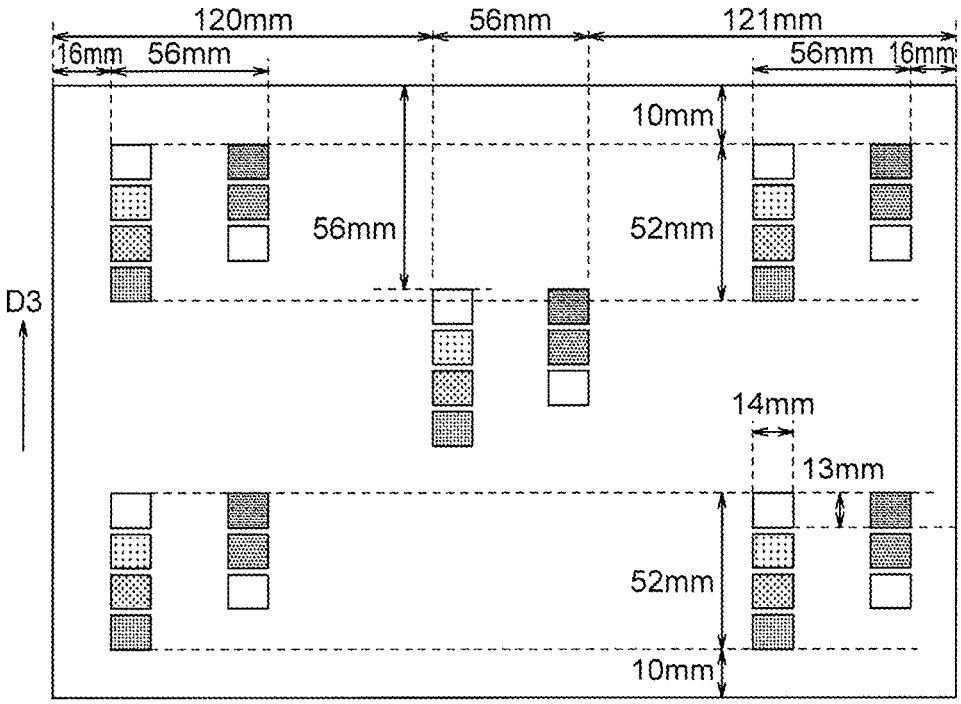
FIG. 7 is a plan view showing positions of toner patches of a print pattern for measurement of the print hue on a sheet.
Figure 8:
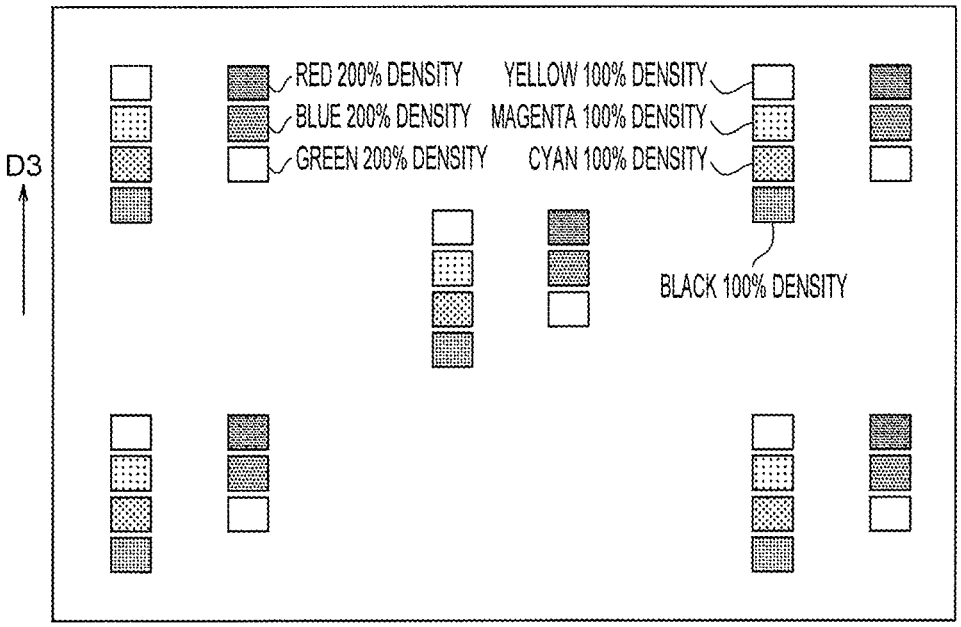
FIG. 8 is a plan view showing the types (colors and densities) of the toner patches of the print pattern for measurement of the print hue.

(2-4) Evaluation Test of Toner According to Second Embodiment in Cases of Compound Color (2-4-1) Procedure of Evaluation Test of Toner in Cases of Compound Color Next, a description will be given of an evaluation test for judging the hue of the yellow toners T1 to T6 in the examples E1 to E3 and the comparative examples C1 to C3 in cases of compound color. FIG. 6 is a plan view showing a sheet that has undergone blank printing. FIG. 7 is a plan view showing positions of toner patches of a print pattern for measurement of print hue on a sheet. FIG. 8 is a plan view showing the types (colors and densities) of the toner patches of the print pattern for measurement of print hue.

The evaluation test of toners in cases of compound color was performed by using a color LED printer "C941dn" produced by Oki Data Corporation, loading the image forming section 10Y with each of the yellow toners T1 to T6 in the examples E1 to E3 and the comparative examples C1 to C3, and using toners of genuine white, magenta, cyan and black toner cartridges, used for the color LED printer "C941dn" produced by Oki Data Corporation, for the image forming sections 10W, 10M, 10C and 10K. As the print medium used in this test, the paper "Excellent White A4 (70 kg paper)" produced by Oki Data Corporation was used.

With the above-described configuration, a test for hue evaluation was carried out according to the following procedure:

<1> Leave the printer in an environment at 22° C. temperature and 40% humidity for 12 hours or longer.

<2> Perform blank printing shown in FIG. 6 for 10 minutes, 30 seconds per sheet.

<3> Print the print hue measurement print pattern shown in FIG. 7 and FIG. 8 on one sheet. In this case, the printing is carried out with the development voltages adjusted so that the optical densities of a yellow 100% (also referred to as "Y100%") density image, a magenta 100% (also referred to as "M100%") density image and a cyan 100% (also referred to as "C100%") density image will be 1.4.

<4> Measure the print hue of a yellow color (yellow toner), a magenta color (magenta toner), a cyan color (cyan toner), a composite color of a red color (yellow toner and magenta toner), a composite color of a green color (yellow toner and cyan toner), and a composite color of a blue color (magenta toner and cyan toner) in hue evaluation patch sets at five positions in the print hue measurement print pattern shown in FIG. 7 and FIG. 8. An average value regarding the five positions was used as the result of the measurement.

The print medium used in this test is the same as the print medium used in this second embodiment.

The print hue measurement print pattern shown in FIG. 7 and FIG. 8 will be explained below. This pattern is printed at five positions on A4 paper as hue evaluation patch sets. The hue evaluation patch sets are printed at the positions shown in FIG. 7. As shown in FIG. 8, each hue evaluation patch set includes a yellow 100% density image, a magenta 100% density image, a cyan 100% density image, a red 200% (also referred to as "R200%") density image, a green 200% (also referred to as "G200%") density image and a blue 200% (also referred to as "B200%") density image. The 100% density image means, in the case of the yellow color, for example, an image obtained by printing with 100% density output by using the yellow toner alone. The red 200% density image means a composite color image obtained by printing with 100% density output of both the yellow color and the magenta color. The green 200% density image means a composite color image obtained by printing with 100% density output of both the yellow color and the cyan color. The blue 200% density image means a composite color image obtained by printing with 100% density output of both the magenta color and the cyan color.

In the judgment on the hue of the red 200% density image, the hue is judged to be excellent as an overall judgment when a judgment by a visual check and a judgment by the print hue of the red color are both excellent. The judgment by a visual check was made by using the red 200% density image in the print obtained by the test, in which the hue was judged to be excellent when the red 200% density image looks equivalent in hue to the red 200% density image obtained by using the yellow toner T4 in the comparative example C1.

(2-4-2) Result of Evaluation Test of Toner in Cases of Compound Color

Figure 9:
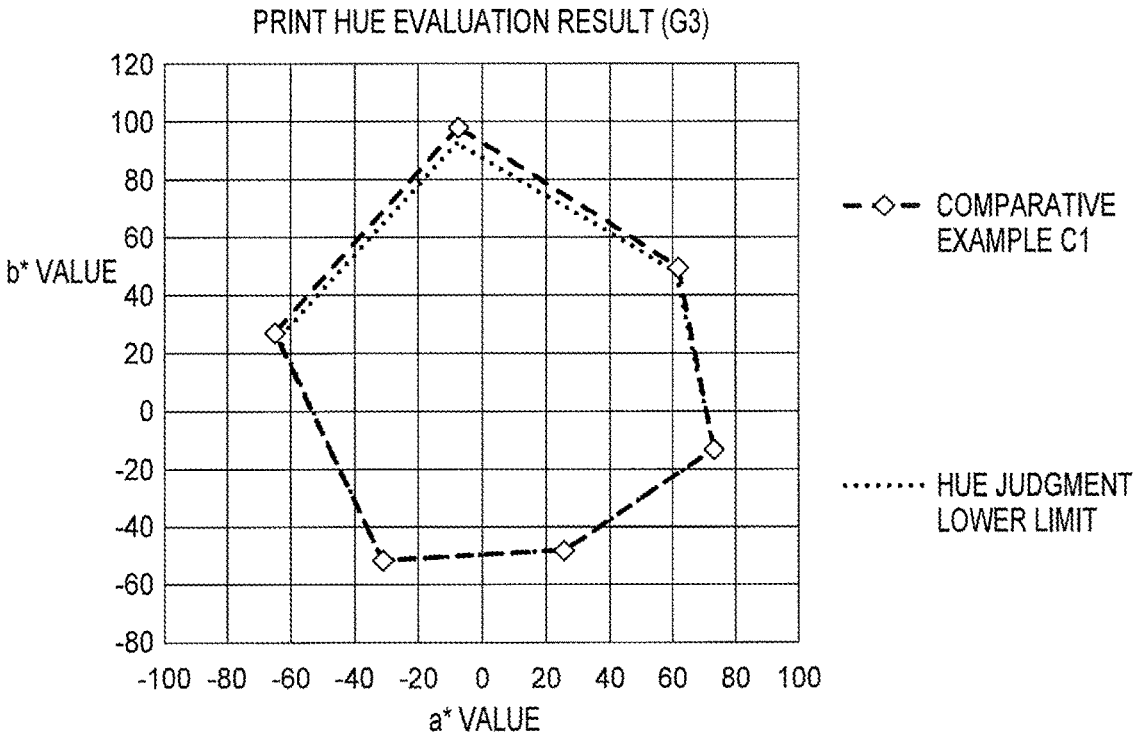
FIG. 9 is a diagram showing a result of evaluation of the print hue of toner patches of red 200% (also referred to as "R200%") density images formed with a yellow toner in a comparative example C1 and an ordinary (commercially available) magenta toner as a graph G3 in the L*a*b* color model.
Figure 10:
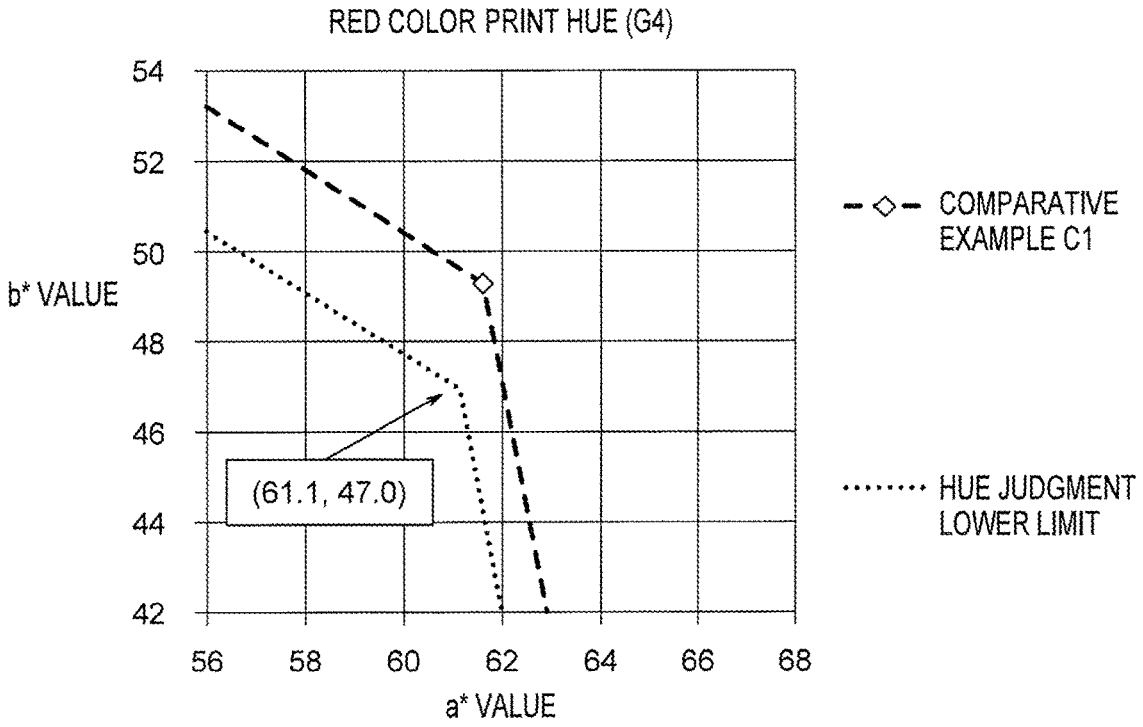
FIG. 10 is a diagram magnifying a principal part of the graph of FIG. 9 as a graph G4.
Figure 11:
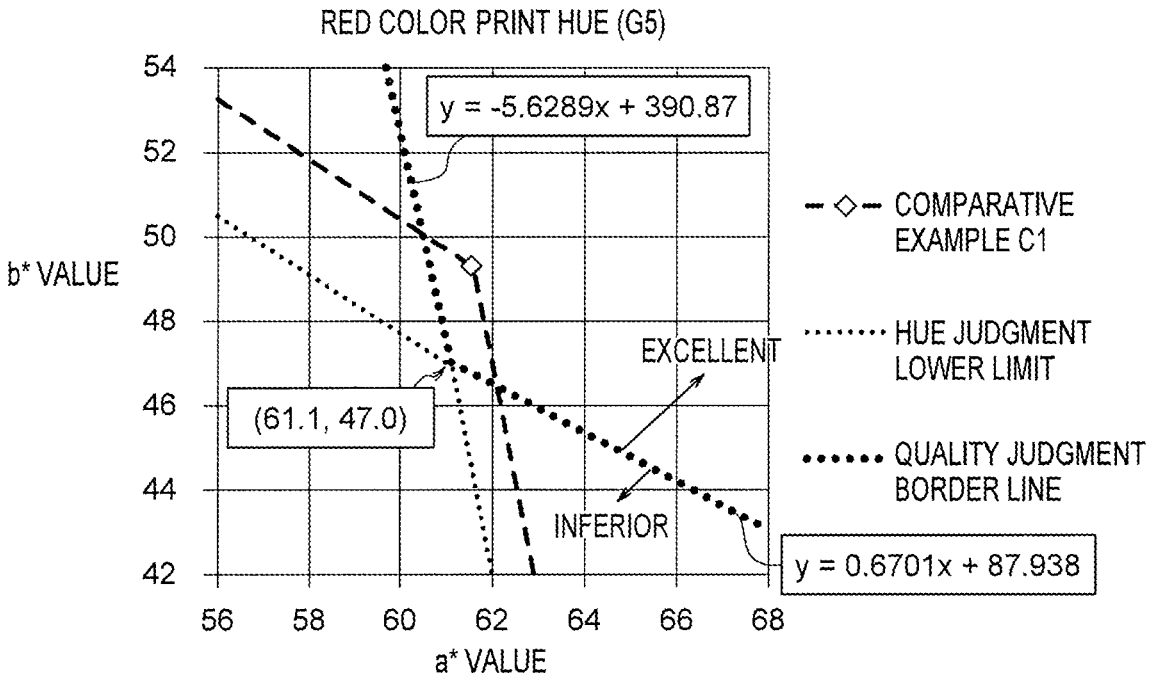
FIG. 11 is a diagram showing a graph G5 obtained by adding a quality judgment border line to FIG. 10.

FIG. 9 is a diagram showing a result of evaluation of the print hue of the toner patches of the red 200% density images formed with the yellow toner T4 in the comparative example C1 and the ordinary (commercially available) magenta toner as a graph G3 in the L*a*b* color model. FIG. 10 is a diagram magnifying a principal part of the graph of FIG. 9 as a graph G4. FIG. 11 is a diagram showing a graph G5 obtained by adding a quality judgment border line to FIG. 10.

The hue judgment lower limit (thin dotted line) in FIG. 9 to FIG. 11 indicates a border line of hue to look equivalent to the red 200% density image formed with the yellow toner T4 in the comparative example C1 and the ordinary (commercially available) magenta toner. As seen in FIG. 9 and FIG. 10 as an enlarged view of the principal part of FIG. 9, the point where the a* value equals 61.1 and the b* value equals 47.0 represents the lower limit of the permissible hue of the red color (hue judgment lower limit). Namely, the hue of red color is excellent in a region above (i.e., outside) the hue judgment lower limit (thin dotted line) in FIG. 9 to FIG. 11.

FIG. 11 shows a quality judgment border line (thick dotted line) formed from the graph G4 of FIG. 10. The quality judgment border line in FIG. 11 is a line formed with lines obtained by extending the straight lines of the hue judgment lower limit (thin dotted lines) shown in FIG. 10. The extended lines are two straight lines represented by the following expressions when the horizontal axis is regarded as the x-axis and the vertical axis is regarded as the y-axis:

$$y=-0.6701x+87.938$$

$$y=-5.6289x+390.87$$

These straight lines represent the quality judgment border line and the print hue is excellent outside the quality judgment border line (thick dotted lines). The reason is as follows: When the print hue of a red color lies outside the quality judgment border line, it seems to be possible to reproduce the lower limit value of the red color hue by modifying the way of forming the composite color with a yellow color and a magenta color, e.g., by forming the composite color with a 95% yellow color and a 97% magenta color.

The result of the evaluation test performed by using the yellow toners T1 to T6 in the examples E1 to E3 and the comparative examples C1 to C3 to check the effect of the toners according to the second embodiment will be shown below as Table 2.

Figure 13:
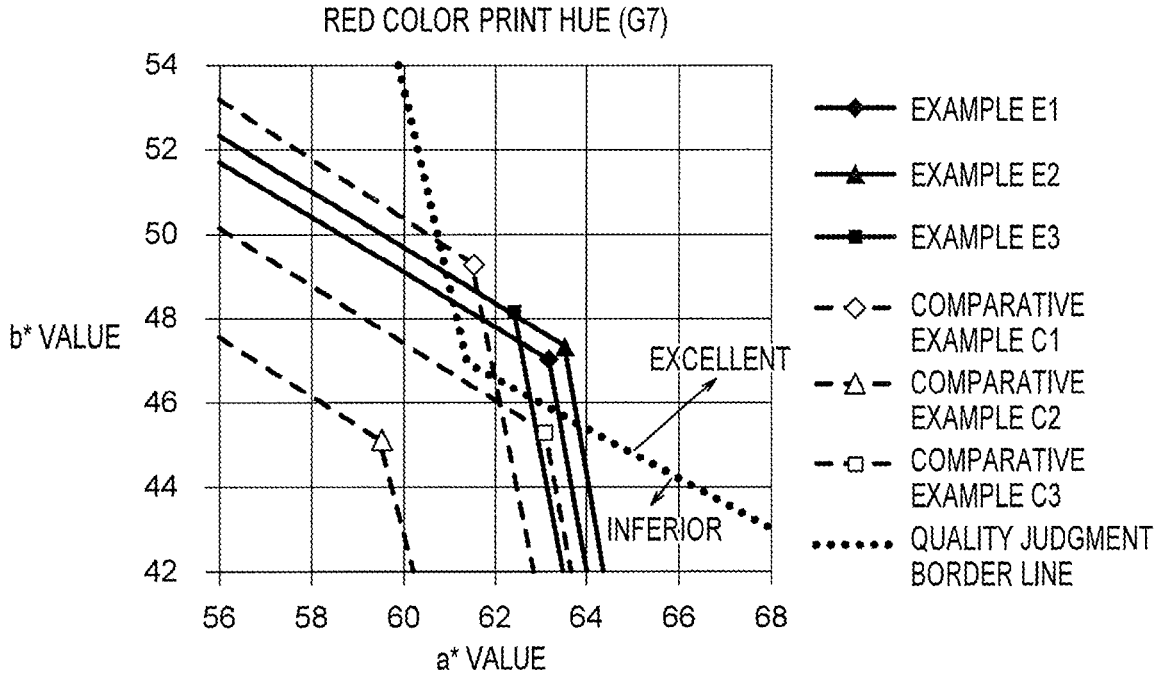
FIG. 13 is a diagram magnifying a principal part of the graph of FIG. 12 as a graph G7.

As seen in FIG. 13, the a* values and the b* values of the hue of the red 200% density images formed by using the yellow toners T1 to T3 in the examples E1, E2 and E3 as the toners according to the second embodiment and the yellow toner T4 in the comparative example C1 were on the excellent side (upper side) of the quality judgment border line and the hue of these red 200% density images was judged to be excellent. In contrast, as seen in FIG. 13, the a* values and the b* values of the hue of the red 200% density images formed by using the yellow toners T5 and T6 in the comparative examples C2 and C3 were on the inferior side (lower side) of the quality judgment border line and the hue of these red 200% density images was judged to be inferior.

It can be considered that the reason why the hue of the red 200% density images formed by using the yellow toners T5 and T6 in the comparative examples C2 and C3 was inferior is that the melt viscosity η was high (Table 1) and it was difficult to form an image in a condition in which the yellow toner and the magenta toner were more desirably molten and mixed together.

As shown in Table 2 as overall judgment, EXCELLENT was obtained as the overall judgment on the hue in the cases where the red 200% density images were formed by using the yellow toners T1 to T3 in the examples E1 to E3 as the toners according to the second embodiment and the yellow toner T4 in the comparative example C1. In the cases where the red 200% density images were formed by using the yellow toners T5 and T6 in the comparative examples C2 and C3, the overall judgment on the hue was inferior.

TABLE 2

| EXAMPLE E1-E3/ COMPARATIVE EXAMPLE C1-C3 | Y TONER | MELT VISCOSITY η [Pa · s] | R200% DENSITY IMAGE (Y100% + M100%) VISUAL CHECK JUDGMENT | R200% DENSITY IMAGE PRINT HUE L* | a* | b* | QUALITY JUDGMENT FIG. 13 | HUE OVERALL JUDGMENT |
|---|---|---|---|---|---|---|---|---|
| E1 | T1 | 1600 | EXCELLENT | 48.7 | 63.2 | 47.1 | EXCELLENT | EXCELLENT |
| E2 | T2 | 1400 | EXCELLENT | 49.0 | 63.6 | 47.3 | EXCELLENT | EXCELLENT |
| E3 | T3 | 1600 | EXCELLENT | 50.0 | 62.5 | 48.1 | EXCELLENT | EXCELLENT |
| C1 | T4 | 1800 | EXCELLENT | 47.4 | 61.9 | 48.5 | EXCELLENT | EXCELLENT |
| C2 | T5 | 2160 | INFERIOR | 48.4 | 59.6 | 45.1 | INFERIOR | INFERIOR |
| C3 | T6 | 2100 | INFERIOR | 48.7 | 63.1 | 45.3 | INFERIOR | INFERIOR |

Figure 12:
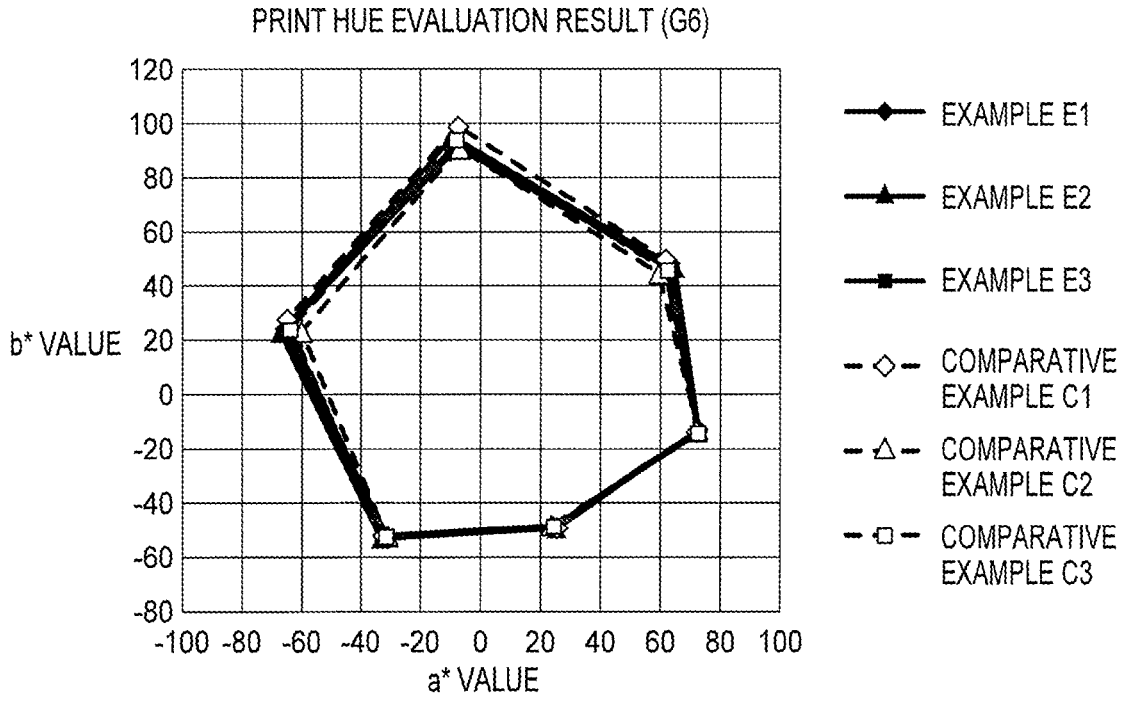
FIG. 12 is a diagram showing a result of evaluation of the print hue of toner patches of red 200% density images formed with each of the yellow toners in the examples E1 to E3 and the comparative examples C1 to C3 and the ordinary (commercially available) magenta toner as a graph G6 in the L*a*b* color model.

FIG. 12 is a diagram showing a result of evaluation of the print hue of the toner patches as the red 208% density images formed with each of the yellow toners T1 to T6 in the examples E1 to E3 and the comparative examples C1 to C3 and the ordinary (commercially available) magenta toner as a graph G6 in the L*a*b* color model. FIG. 13 is a diagram magnifying a principal part of the graph G6 of FIG. 12 as a graph G7.

As seen in Table 2, the hue of the red 200% density images formed by using the yellow toners T1 to T3 in the examples E1, E2 and E3 as the toners according to the second embodiment and the yellow toner T4 in the comparative example C1 was judged to be excellent as the result of the visual check judgment. In contrast, as seen in Table 2, the hue of the red 200% density images formed by using the yellow toners T5 and T6 in the comparative examples C2 and C3 was judged to be inferior as the result of the visual check judgment.

(2-5) Effect of Second Embodiment

According to the evaluation result of the print images with the yellow toners T1 to T6 shown in Table 1 and the evaluation result of the red 200% density images by using the yellow toners T1 to T6 shown in Table 2, both of the judgment on the yellow print image and the judgment on the red 200% density image resulted in excellent in the cases of using the yellow toners T1 to T3 in the examples E1 to E3.

Therefore, it becomes possible to form a print image having an excellent color tone and excelling in the light resistance by configuring the toner according to the second embodiment to satisfy both of the aforementioned conditions (1) and (2) and to satisfy the aforementioned condition (3).

(3) Third Embodiment (3-1) Outline of Third Embodiment

In the above second embodiment, the description has been given of toners that make it possible to form a print image having an excellent color tone and excelling in the light resistance. However, there are cases where printing of a toner image (also referred to as "iron printing") is carried out by means of thermocompression bonding of transfer paper, as a special-purpose transfer medium having the toner image thereon, to a final medium such as fabric (e.g., T-shirt). The transfer paper is the print medium 23 in the image forming apparatus 1 according to the first embodiment.

In such cases of transferring and thermocompression-bonding a toner image on transfer paper to a final medium such as fabric, color degradation can occur in the print image obtained by the thermocompression bonding process. This can be attributed to sublimation of part of the pigments included in the toners due to heat.

In the third embodiment, a description will be given of a toner capable of forming an excellent print image excelling in the sublimation resistance, having an excellent color tone, and excelling in the light resistance. The toner according to the third embodiment is usable as a yellow toner as a developing agent in the image forming apparatus 1 and the toner cartridge described in the above first embodiment. Incidentally, the sublimation resistance is an index representing the degree of how unlikely an object substance (in the third embodiment, the pigment included in the toner) is to be sublimated. With the increase in the sublimation resistance, the object substance is less likely to be sublimated, that is, the pigment is less likely to disappear from the toner image due to sublimation.

The toner according to the third embodiment is a non-magnetic monocomponent yellow toner. The configuration of each particle of the toner according to the third embodiment is the same as that shown in FIG. 3. The toner according to the third embodiment is stored in the image forming apparatus 1 according to the first embodiment, the development device 11Y, and the toner cartridge (toner storage part 18Y in FIG. 1) attached to the development device 11Y. The Loner according to the third embodiment includes the binder resin 101 having a particulate shape such as styrene acryl and the coloring agent (color material) 102 provided (dispersed) in the binder resin 101. Further, the toner according to the third embodiment may include the wax 103 provided (dispersed) in the binder resin 101 and the external additive 104 such as silica or titanium oxide adhering to the surface of the coloring resin particle as the binder resin 101 including the coloring agent 102. Furthermore, the toner according to the third embodiment may include the charge control agent as the additive for controlling the polarity and the electrification amount of the toner electrically charged.

The coloring agent 102 includes one or more types of yellow pigment. The coloring agent 102 in the toner according to the third embodiment is configured so that the print hue of the hue measurement print image (yellow 100% density image shown in FIG. 8) as the toner image printed on a sheet as the print medium by the image forming apparatus 1 according to the first embodiment satisfies both of the conditions (1) and (2) similarly to the case of the second embodiment.

$$-8.6 \leq a^*(Y) \leq -7.9 \quad (1)$$

$$93.4 \leq b^*(Y) \leq 95.4 \quad (2)$$

Further, the toner according to the third embodiment is configured so that the melt viscosity η (Pa·s) of the toner at 120° C. satisfies the condition (3) similarly to the case of the second embodiment.

$$1400(\text{Pa}\cdot\text{s}) \leq \eta \leq 1600(\text{Pa}\cdot\text{s}) \quad (3)$$

Furthermore, the coloring agent 102 of the toner according to the third embodiment is desired to be configured so that the light resistance F (%) of the light resistance measurement print image as a toner image printed on a sheet as the print medium by the image forming apparatus 1 according to the first embodiment, after being irradiated with light having 0.36 W/m$^2$ spectral irradiance at the 340 nm wavelength for 663 hours (i.e., after the irradiation test), satisfies the condition (4) similarly to the case of the second embodiment.

$$F \geq 70\% \quad (4)$$

Moreover, the coloring agent 102 of the toner according to the third embodiment is desired to be configured so that the sublimation resistance Sr (%) of a sublimation resistance measurement print image as a toner image (i.e., yellow 100% density image) printed on a sheet as the print medium (transfer paper in the third embodiment) by the image forming apparatus 1 according to the first embodiment, after being heated at 180° C. for 10 minutes (i.e., after a heating test), satisfies the following condition (5):

$$Sr\ (\%) \geq 98(\%)$$

$$Sr\ (\%) = (b^*(E)/b^*(S)) \times 100(\%) \quad (5)$$

where b*(E) represents the b* value of the yellow 100% density image after the heating test and b*(S) represents the b* value of the yellow 100% density image before the heating test.

In addition, the coloring agent 102 of the toner according to the third embodiment is desired to be configured so that the b* value of a thermocompression bonding transferability measurement print image as a toner image printed on transfer paper for the thermocompression bonding transfer by the image forming apparatus 1 according to the first embodiment, after being pressed at 180° C. and 60 psi for 10 seconds (i.e., after a thermocompression bonding transfer test), satisfies the following condition (6):

$$b^*(P) \leq 2.9 \quad (6)$$

where b*(P) represents the b* value of the yellow 100% density image (i.e., thermocompression bonding transferability measurement print image) after the thermocompression bonding transfer test.

The basis of the upper limits and the lower limits in the above conditions (1) to (6) in regard to the toner (i.e., yellow toner) according to the third embodiment will be described later with reference to Table 3 in FIG. 14 and FIG. 15, FIG. 16, FIG. 19 and FIG. 21 showing the result of evaluation tests performed on yellow toners T11 to T15 in examples E11 to E15 as toners according to the third embodiment and yellow toners T16 to T18 in comparative examples C11 to C13.

Further, evaluation of a red image (compound color image) in a case where the red image is printed by using the toner (yellow toner) according to the third embodiment and a conventional magenta toner will be described later with reference to Table 4 in FIG. 22, FIG. 23 and FIG. 24.

Print images formed by use of the toner according to the third embodiment have excellent color tones, excel in the light resistance, excel in the sublimation resistance, and excel in the thermocompression bonding transferability.

(3-2) Manufacturing Process of Toner According to Third Embodiment

The toner according to the third embodiment is manufactured by the following manufacturing process using emulsion polymerization, for example:

(Preparation Step)

Styrene-acrylic copolymer resin as binder resin (101 in FIG. 3) and a coloring agent (102 in FIG. 3) are prepared, and wax (103 in FIG. 3), an external additive (104 in FIG. 3) and a charge control agent are also prepared as needed.

The styrene-acrylic copolymer resin can be produced from styrene, acrylic acid and methyl methacrylate.

The coloring agent is a mixture of C.I. Pigment Yellow (PY) 155 and C.I. Pigment Yellow (PY) 185 as yellow pigments at a ratio within a range from 73:27 to 80:20. However, the pigment of the coloring agent in the comparative example C11 includes C.I. Pigment Yellow 74 at the ratio of 100%.

The reason why the pigment mixture ratio is set higher than or equal to 73:27 is that it was impossible to produce the coloring resin particles by mixing coloring agents by means of emulsion polymerization when the mixture ratio was less than 73:27. Namely, the reason is that production of the coloring resin particles by emulsion polymerization became impossible as a mixture ratio of PY 155 was gradually increased.

The reason why the pigment mixture ratio is set lower than or equal to 80:20 is that the print hue of the yellow 100% density image deteriorates and the yellow color becomes pale to a visually recognizable level when the mixture ratio is higher than 80:20. Incidentally, this was confirmed by a drop in the b* value representing the print hue in regard to the comparative example C12 shown in Table 3 in FIG. 14.

The wax is paraffin wax.

The external additive is the same silica as that described in the second embodiment, including hydrophobic silica fine powder whose average particle diameter is 8 nm to 20 nm, hydrophobic silica fine powder whose average particle diameter is 20 nm to 80 nm, and colloidal silica fine powder whose average particle diameter is 80 nm to 140 nm, for example.

(Coloring Resin Particle Formation Step)

Subsequently, the styrene-acrylic copolymer resin, and the coloring agent, together with the wax and the charge control agent as needed, are mixed together by using emulsion polymerization, and the coloring resin particles are generated by cohesion. The coloring resin particle formation step in the third embodiment is the same as that described in the second embodiment.

(External Additive Adhesion Step)

Subsequently, the silica as the external additive is mixed into the coloring resin particles by using a mixer, by which a nonmagnetic monocomponent toner like the one shown in FIG. 3 is manufactured. The external additive adhesion step in the third embodiment is the same as that described in the second embodiment.

(3-3) Evaluation Test of Toner According to Third Embodiment (3-3-1) Outline of Evaluation Test of Yellow Toner The yellow toners T11 to T15 in the examples E11 to E15 were manufactured as the toners according to the third embodiment. Further, the yellow toners T16 to T18 in the comparative examples C11 to C13 were manufactured.

The evaluation test was performed on these yellow toners T11 to T18. In the evaluation test, the yellow 100% density images of the yellow toners T11 to T18 were printed on a white paper medium (sheet), the L* value, the a* value and the b* value in the L*a*b* color model were measured as the print hue, the optical density (O.D.) in the aforementioned calculation formula of the light resistance F (%) was measured, and the light resistance F (%) was calculated from the O.D.

Further, in the evaluation test, the melt viscosity η (Pa·s) of each of the yellow toners T11 to T18 was measured.

(3-3-2) Measurement of Hue (Print Hue) of Yellow Toner Print Image (Measuring Instrument)

For the measurement of the L* value, the a* value and the b* value representing the print hue in the L*a*b* color model, the measuring instrument "X-Rite528" (produced by X-Rite Inc.) as a colorimeter/densitometer was used.

(Underlay for Print Medium)

In the measurement in the third embodiment, the same underlay as that used in the measurement in the second embodiment was used as the underlay for the print medium.

(Setting of Measuring Instrument)

For the measurement of print hue of the print images with the yellow toners T11 to T18, measurement conditions in the measuring instrument "X-Rite528" were set as follows:

The measurement mode was set at "measurement mode by L*a*b* color model", the observation light source (illuminant) was set at "D50", and the viewing angle (observation field) was set at "2°".

(Measurement)

The hue of the print obtained on the print medium by using each of the yellow toners T11 to T18 was measured by use of the measuring instrument "X-Rite528" with the above-described settings.

(3-3-3) Measurement of Optical Density in Measurement of Hue of Yellow Toner (Measuring Instrument)

The optical density was employed as the parameter indicating the density of the toner print image. As the measuring instrument for measuring the optical density, the measuring instrument "X-Rite528" was used.

(Underlay for Print Medium)

In the measurement of optical density of the print images by use of the measuring instrument "X-Rite528", a black paper medium (i.e., black paper) was used as the underlay for the print medium. In the measurement in the third embodiment, the same underlay as that used in the measurement in the second embodiment was used as the underlay for the print medium.

(Setting of Measuring Instrument)

For the measurement of optical density of the print images with the yellow toners T11 to T18, measurement conditions in the measuring instrument "X-Rite528" were set as follows:

In the third embodiment, similarly to the case of the second embodiment, the measurement mode was set at "density measurement mode", the status setting was set at "status I", the white reference setting was set at "absolute white reference", and the filer setting was set at "no polarizing filter". The "status I" is stipulated in ISO as mentioned in the second embodiment.

(Measurement)

The optical density of each print was measured by use of the measuring instrument "X-Rite528" with the above-described settings. In the measuring instrument "X-Rite528", the optical density is obtained as the four numerical values: the V value, the C value, the M value and the Y value. The Y value was used as the optical density of the yellow toners T11 to T18, the M value was used as the optical density of the magenta toner, and the C value was used as the optical density of the cyan toner.

(3-3-4) Measurement of Melt Viscosity of Yellow Toner

As the parameter indicating the melt viscosity of the toner, the melt viscosity η (Pa·s) at 120° C. obtained from viscoelasticity measurement by use of the rotary rheometer was employed.

The melt viscosity η measurement method is the same as the measurement method in the second embodiment. Namely, the temperature rise rate was set at 5° C./min, the frequency was set at 1 Hz, the gap was set at 1 mm, the yellow toners T11 to T18 were first melted sufficiently at the temperature of 140° C. by using the parallel plate having the ϕ20 mm diameter, thereafter the yellow toners T11 to T18 were heated from 50° C. to 230° C., and the melt viscosity η (Pa·s) when the yellow toners T11 to T18 were at 120° C. was obtained.

(3-3-5) Measurement of Optical Density for Calculating Light Resistance of Yellow Toner Print Image (Irradiation Test)

For the measurement of the light resistance F (%) of each yellow toner T11-T18, a survival rate (%) of the O.D. of the toner image on the print, in the case where the light resistance test using the xenon arc lamp was performed on the print with the yellow toner T11-T18, was employed.

The light resistance test using the xenon arc lamp is the same as the light resistance test in the second embodiment, and the light resistance F (%) was obtained from the expression (5).

(Measuring Instrument)

For the measurement of the optical density of the toner image in the measurement of light resistance, the measuring instrument "X-Rite528" (produced by X-Rite Inc.) was used.

(Underlay for Print Medium)

The underlay for the print medium used in the measurement of optical density by use of "X-Rite528" in the third embodiment is the same as the underlay in the second embodiment.

(Setting of Measuring Instrument)

For the measurement of optical density of the print images with the yellow toners T11 to T18, measurement conditions in the measuring instrument "X-Rite528" were set as follows: The measurement mode was set at "density measurement mode", the status setting was set at "status I", the white reference setting was set at "absolute white reference", and the filer setting was set at "no polarizing filter".

With the above-described settings, the optical density of the print obtained on the print medium by using each of the yellow toners T11 to T18 was measured by use of the measuring instrument "X-Rite528" at a plurality of time points in the irradiation test. In the measuring instrument "X-Rite528", the optical density is obtained as the four numerical values: the V value, the C value, the M value and the Y value, in which the Y value was used as the optical density of the yellow toners T11 to T18.

(Measurement)

The optical density of the print obtained on the print medium by using each of the yellow toners T11 to T18 was measured by use of the measuring instrument "X-Rite528" with the above-described settings.

(3-3-6) Measurement of Sublimation Resistance of Yellow Toner Print Image (Test)

For the measurement of the sublimation resistance Sr (%) of each yellow toner T11-T18, the survival rate (%) of the b* value of the toner image on the print, after performing a heating test with a hot plate on the print with the yellow toner T11-T18, was employed.

Figure 17:
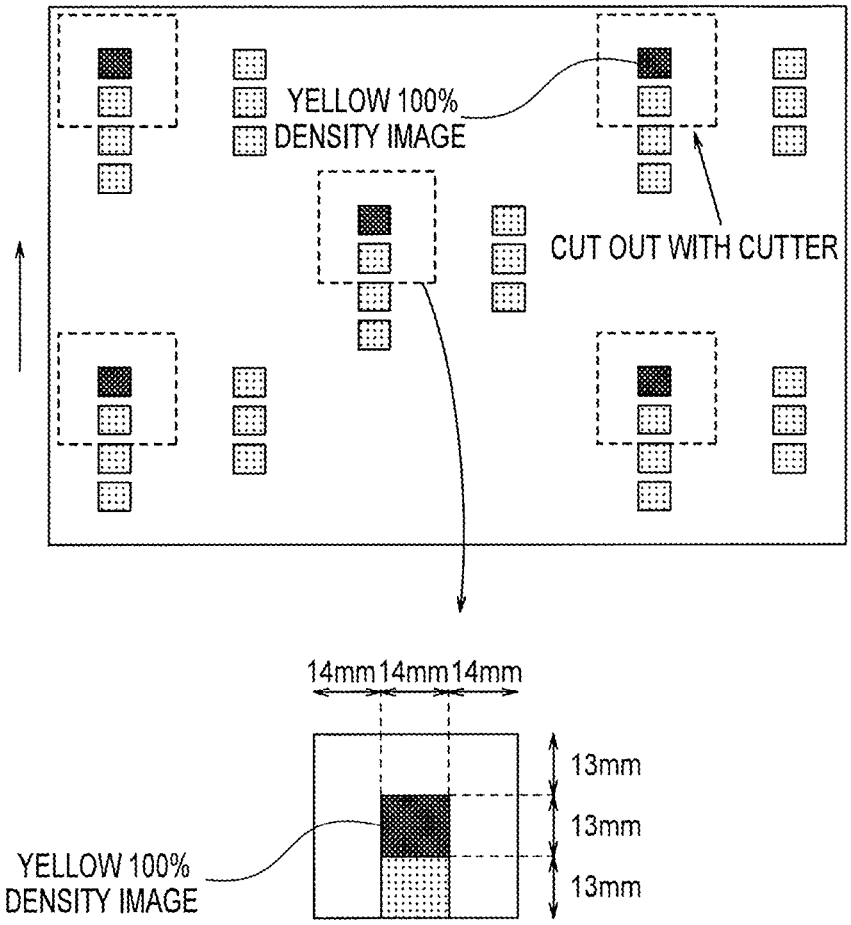
FIG. 17 is a plan view showing a sublimation resistance measurement print image.

For the heating test, "DIGITAL HOT PLATE/STIRRER DP-1M" as a hot plate (301 in FIG. 18) produced by AS ONE Corporation was used as a heating device. First, as a print image for the measurement of sublimation resistance, a toner image at an O.D. of 1.4 (yellow monochrome solid image) formed on the Excellent White A4 (70 kg paper) produced by Oki Data Corporation is generated. As the print image for the measurement of sublimation resistance, an image cut from, namely, cut out from, the hue measurement image shown in FIG. 7 and FIG. 8 as shown in FIG. 17 was used similarly to the case of the second embodiment.

Subsequently, the b* value of the yellow 100% density image in the sublimation resistance measurement print image is measured. This b* value is described also as b*(S). Subsequently, the set temperature of the hot plate is set at 180° C., and the hot plate is left untouched until the surface temperature of the hot plate reaches 180° C. The surface temperature of the hot plate is measured by using a radiation thermometer or the like, for example.

Figure 18:
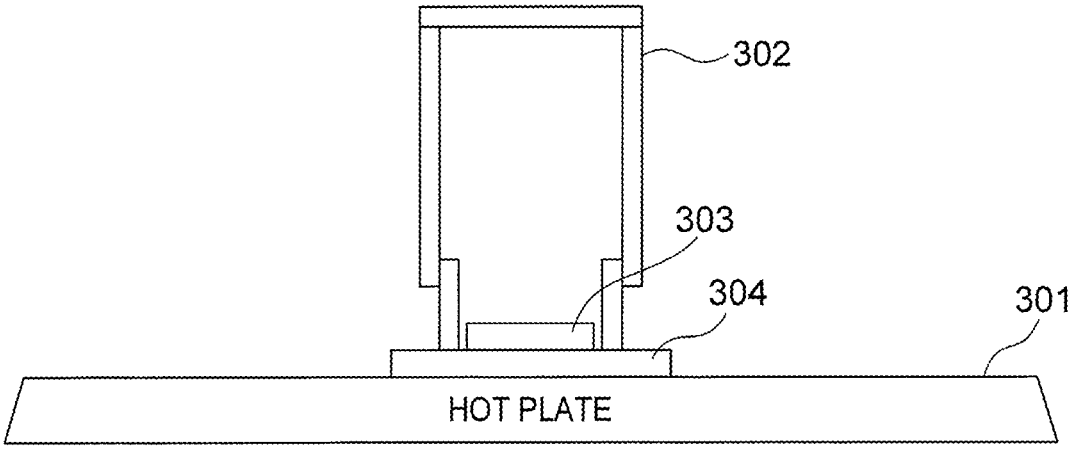
FIG. 18 is a schematic diagram for explaining a heating test method in the measurement of sublimation resistance.

Subsequently, as shown in FIG. 18, the print 304 is set on a hot plate 301 so that the yellow 100% density image 303 in the sublimation resistance measurement print image faces upward, a weight 302 is placed to eliminate a gap between the print 304 and the hot plate 301, and the print 304 is heated for 10 minutes. Used as the weight 302 is a weight not contacting the yellow 100% density image 303 and having weight sufficient to eliminate the gap between the hot plate 301 and the print 304. As the weight 302, Laboran Screw Tube Jar 13.5 cc produced by AS ONE Corporation was used in the upside-down position.

After heating the print for 10 minutes, the b* value of the yellow 100% density image 303 in the sublimation resistance measurement print image is measured. This b* value is described also as b*(E).

The sublimation resistance Sr (%) was calculated from b*(S) and b*(E) obtained as above and the following calculation formula (7) of the sublimation resistance Sr (%):

$$Sr\ (\%)=(b^*(E)/b^*(S))\times 100(\%) \quad (7)$$

The optical density and hue measurement method in the measurement of sublimation resistance is performed in the same way as the method in the measurement of light resistance.

Figure 20:
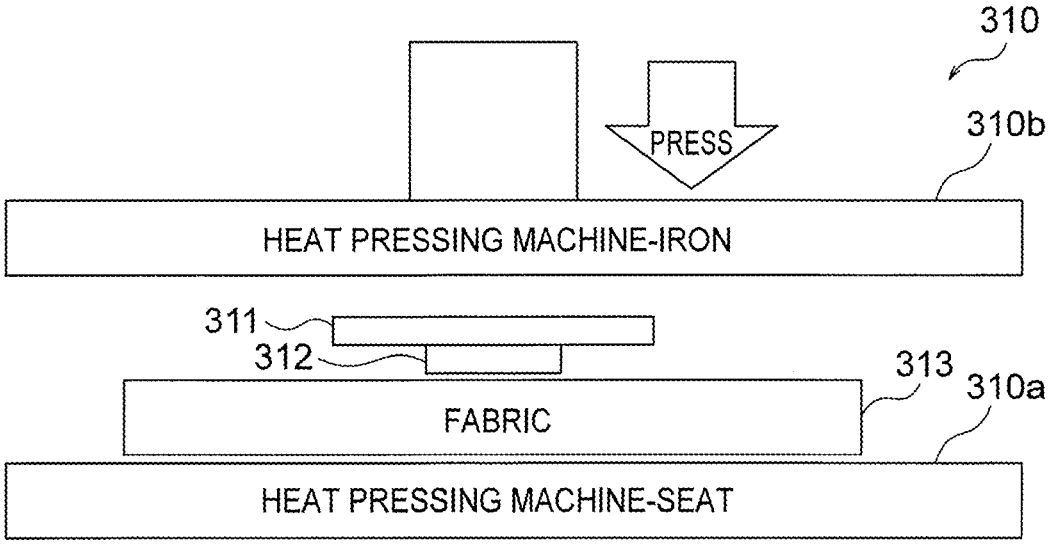
FIG. 20 is a schematic diagram for explaining a thermocompression bonding transfer method in the measurement of thermocompression bonding transferability.

(3-3-7) Measurement of Thermocompression Bonding Transferability of Yellow Toner Print Image FIG. 20 is a schematic diagram for explaining a thermocompression bonding transfer method in the measurement of thermocompression bonding transferability. The measurement of thermocompression bonding transferability of the yellow toners T11 to T18 was carried out by conducting a thermocompression bonding transfer test by use of a heat pressing machine 310 for T-shirt printing. In the thermocompression bonding transfer test, a yellow 100% density image 312 printed on thermocompression bonding transfer paper 311 was pressed between a seat 310*a* and an iron 310*b* of the heat pressing machine 310, the thermocompression bonding was performed on fabric (e.g., T-shirt) 313, and thereafter the b* value of the toner image remaining on the used thermocompression bonding transfer paper was measured.

As the heat pressing machine 310, an iron pressing machine "Model HTP234PS1" produced by BIOTECH Co., Ltd. was used. As the thermocompression bonding transfer paper 311, "TCC3.1" produced by BIOTECH Co., Ltd. was used. As the fabric (T-shirt), "United Athle 5806-01 4.0 oz. white" of C.A.B. CLOTHING INC. was used.

In the measurement, a thermocompression bonding print 311 as a yellow 100% density image at an O.D. of 1.4 printed on thermocompression bonding transfer paper is generated first.

Subsequently, the set temperature of the heat pressing machine 310 is set at 180° C. and the heat pressing machine 310 is left untouched until a thermometer (not shown) of the machine indicates 180° C. Then, as shown in FIG. 20, the fabric (T-shirt) 313 is set on the seat 310*a* of the heat pressing machine 310, the thermocompression bonding print 311 with the yellow 100% density image 312 facing downward is set on the fabric (T-shirt 313), and the fabric (T-shirt) 313 with the thermocompression bonding print 311 set thereon are pressed for 10 seconds.

The pressing pressure of the heat pressing machine 310 in the press was adjusted to 60 psi. When the iron pressing machine "Model HTP234PS1" is used as the heat pressing machine 310, the pressing pressure can be adjusted to 60 psi by setting a pressure regulation dial at "Dial 8".

After the elapse of five seconds since the start of the heat press by the heat pressing machine 310, the thermocompression bonding print 311 is peeled from the fabric (T-shirt) 313. Then, the b* value of the yellow 100% density image on the thermocompression bonded print 311 after undergoing the heat press is measured. The optical density measurement method and the hue measurement method in the measurement of thermocompression bonding transferability are the same as those in the measurement of light resistance.

(3-3-8) Result of Evaluation Test of Yellow Toner

Table 3 in FIG. 14 shows a result of measurement of the pigment ratio between C.I. Pigment Yellow 155 (PY 155) and C.I. Pigment Yellow 185 (PY 185), the print hue, the light resistance F (%), the sublimation resistance Sr (%), the b* value of the yellow 100% density image after the thermocompression bonding transfer measurement, and the melt viscosity η (Pa·s) at 120° C. of the yellow toners T11 to T15 in the examples E11 to E15 as the toners according to the third embodiment and the yellow toners T16 to T18 in the comparative examples C11 to C13. Incidentally, the pigment of the yellow toner T16 in the comparative example C11 includes C.I. Pigment Yellow 74 (PY 74) at the ratio of 100%.

The yellow toner T11 in the example E11 is an example of the toner according to the third embodiment. In the yellow toner T11, the coloring agent includes C.I. Pigment Yellow 155 and C.I. Pigment Yellow 185 at the ratio of 80:20. In the yellow toner T11, the melt viscosity η (Pa·s) at 120° C. is adjusted to 1600 (Pa·s) by lowering the molecular weight of the binder resin compared to that in an ordinary (commercially available) yellow toner (yellow toner T16 in the comparative example C11).

The yellow toner T12 in the example E12 is an example of the toner according to the third embodiment. In the yellow toner T12, the coloring agent includes C.I. Pigment Yellow 155 and C.I. Pigment Yellow 185 at the ratio of 80:20. In the yellow toner T12, the melt viscosity η (Pa·s) at 120° C. is adjusted to 1400 (Pa·s) by using binder resin differing in the molecular weight from the binder resin of the yellow toner T11.

The yellow toner T13 in the example E13 is an example of the toner according to the third embodiment. In the yellow toner T13, the coloring agent includes C.I. Pigment Yellow 155 and C.I. Pigment Yellow 185 at the ratio of 80:20. In the yellow toner T13, the melt viscosity η (Pa·s) at 120° C. is adjusted to 1600 (Pa·s) while using binder resin differing in the molecular weight from the binder resin of the yellow toner T11.

The yellow toner T14 in the example E14 is an example of the toner according to the third embodiment. In the yellow toner T14, the coloring agent includes C.I. Pigment Yellow 155 and C.I. Pigment Yellow 185 at the ratio of 76.5:23.5. In the yellow toner T14, binder resin equal in the molecular weight to the binder resin of the yellow toner T11 is used as the binder resin. The melt viscosity η at 120° C. of the yellow toner T14 in the example E14 configured as above is 1400 (Pa·s).

The yellow toner T15 in the example E15 is an example of the toner according to the third embodiment. In the yellow toner T15, the coloring agent includes C.I. Pigment Yellow 155 and C.I. Pigment Yellow 185 at the ratio of 73:27. In the yellow toner T15, binder resin equal in the molecular weight to the binder resin of the yellow toner. T11 is used as the binder resin. The melt viscosity η at 120° C. of the yellow toner T15 in the example E15 configured as above is 1600 (Pa·s).

The yellow toner T16 in the comparative example C11 is an ordinary (commercially available) yellow toner. The yellow toner T16 is the yellow toner of the genuine yellow toner cartridge used for the color LED printer "C911dn" produced by Oki Data Corporation. In the yellow toner T16 in the comparative example C11, the coloring agent includes C.I. Pigment Yellow 74 at the ratio of 100%. The melt viscosity η of this yellow toner T16 at 120° C. is 1800 (Pa·s).

In the yellow toner T17 in the comparative example C12, the coloring agent is C.I. Pigment Yellow 155. In the yellow toner T17, the molecular weight of the binder resin is set equivalent to that in the yellow toner T16 in the comparative example C11. The melt viscosity η at 120° C. of the yellow toner T17 in the comparative example C12 configured as above is 2160 (Pa·s).

In the yellow toner T18 in the comparative example C13, the coloring agent includes C.I. Pigment Yellow 155 and C.I. Pigment Yellow 185 at the ratio of 80:20. In the yellow toner T18, the molecular weight of the binder resin is set equivalent to that in the yellow toner T16 in the comparative example C11. The melt viscosity η at 120° C. of the yellow toner T18 in the comparative example C13 configured as above is 2100 (Pa·s).

In the yellow toners T11 to T15 in the examples E11 to E15, the pigments are selected so that the print hue satisfies both of the conditions (1) and (2). In regard to the coloring agents C.I. Pigment Yellow 155 and C.I. Pigment Yellow 185, the reason why there is no toner with the C.I. Pigment Yellow 185 ratio over 27% in the examples E11 to E15 and the comparative examples C11 to C13 is that it was impossible to produce a toner with a still increased ratio of C.I. Pigment Yellow 185 due to a problem in production.

The toner images with the yellow toners T11 to T15 in the examples E11 to E15 have excellent color tones equivalent to the color tone of the toner image with the conventional yellow toner T16 represented by the comparative example C11.

Even these toner images (prints) having print hues different from each other look like they have color tones equivalent to each other, which can be attributed to the human eye lacking the ability to perceive a slight difference between yellow colors and recognizing such images as images of the same color tone.

Further, it has been known that the light resistance F (%) generally decreases as a pigment achieving a yellow print hue with a higher b* value in the yellow color is used in a yellow toner. Namely, the light resistance F (%) decreases with the increase in the b* value of the yellow toner.

In the yellow toners T11 to T15 as the toners according to the third embodiment, the upper limit "95.4" of the b* value in the aforementioned condition (2) is a value for letting the toner have better light resistance than the conventional yellow toner T16 represented by the comparative example C11.

Figure 15:
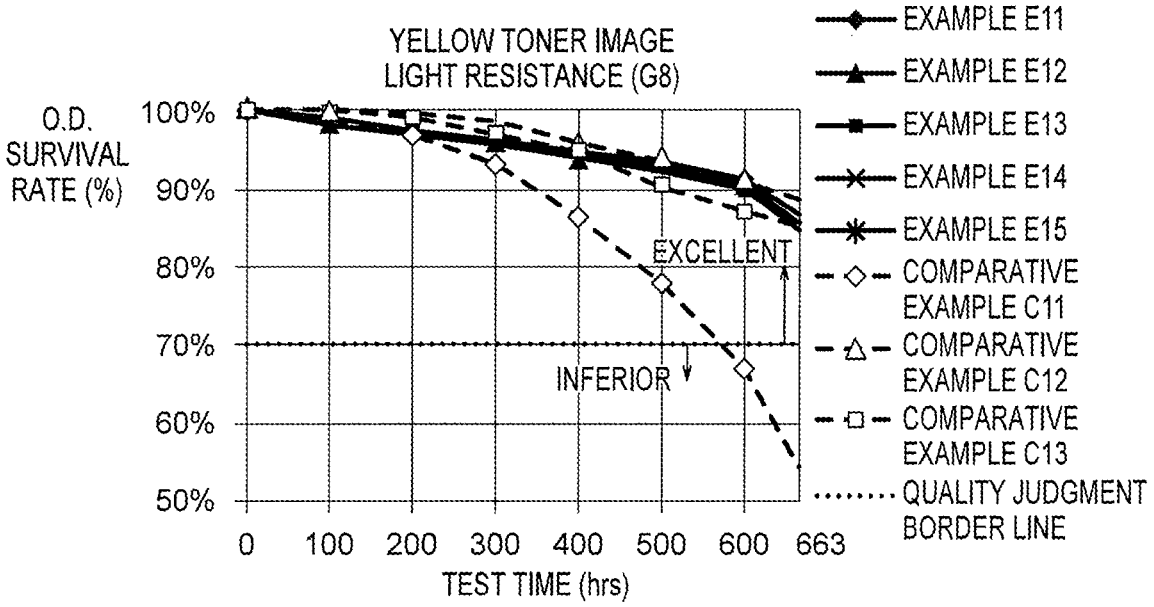
FIG. 15 is a diagram showing a result of a light resistance test of print images formed with the yellow toners (examples E11 to E15) as the toners according to the third embodiment and print images formed with the yellow toners in the comparative examples (examples C11 to C13) as a graph G8.

FIG. 15 is a diagram showing a result of the light resistance test of the print images formed with the yellow toners T11 to T15 (examples E11 to E15) according to the third embodiment and the print images formed with the yellow toners T16 to T18 in the comparative examples (comparative examples C11 to C13) as a graph G8.

Figure 16:
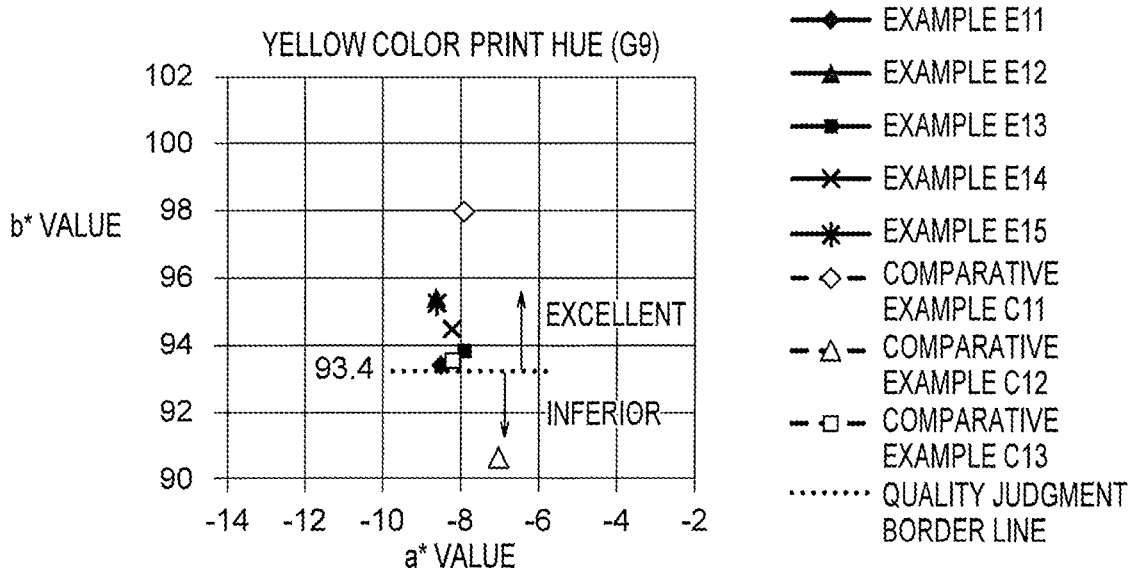
FIG. 16 is a diagram showing a result of measurement of the print hue of print images formed with the yellow toners (examples E11 to E15) as the toners according to the third embodiment and print images formed with the yellow toners in the comparative examples (examples C11 to C13) as a graph G9 in the L*a*b* color model.

FIG. 16 is a diagram showing a result of the measurement of print hue of the print images formed with the yellow toners T11 to T15 (examples E11 to E15) according to the third embodiment and the print images formed with the yellow toners T16 to T18 in the comparative examples (examples C11 to C13) as a graph G9 in the L*a*b* color model.

Figure 19:
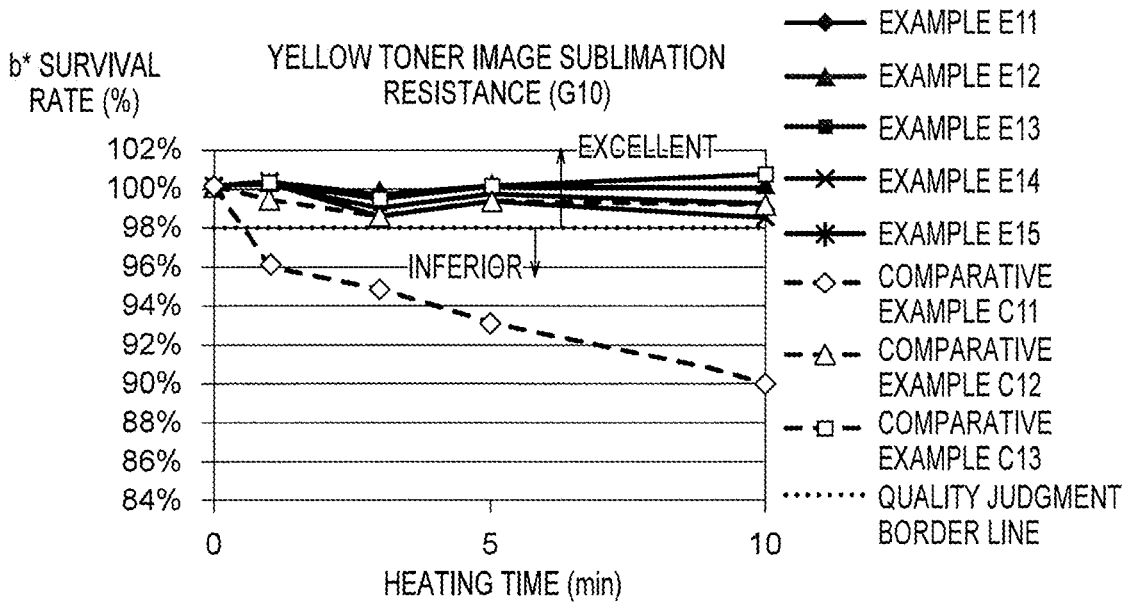
FIG. 19 is a diagram showing the sublimation resistance of print images formed with the yellow toners (examples E11 to E15) as the toners according to the third embodiment and print images foisted with the yellow toners in the comparative examples (examples C11 to C13) as a graph G10.

FIG. 19 is a diagram showing a result of the sublimation resistance test of the print images formed with the yellow toners T11 to T15 (examples E11 to E15) according to the third embodiment and the print images formed with the yellow toners T16 to T18 in the comparative examples (comparative examples C11 to C13) as a graph G10.

Figure 21:
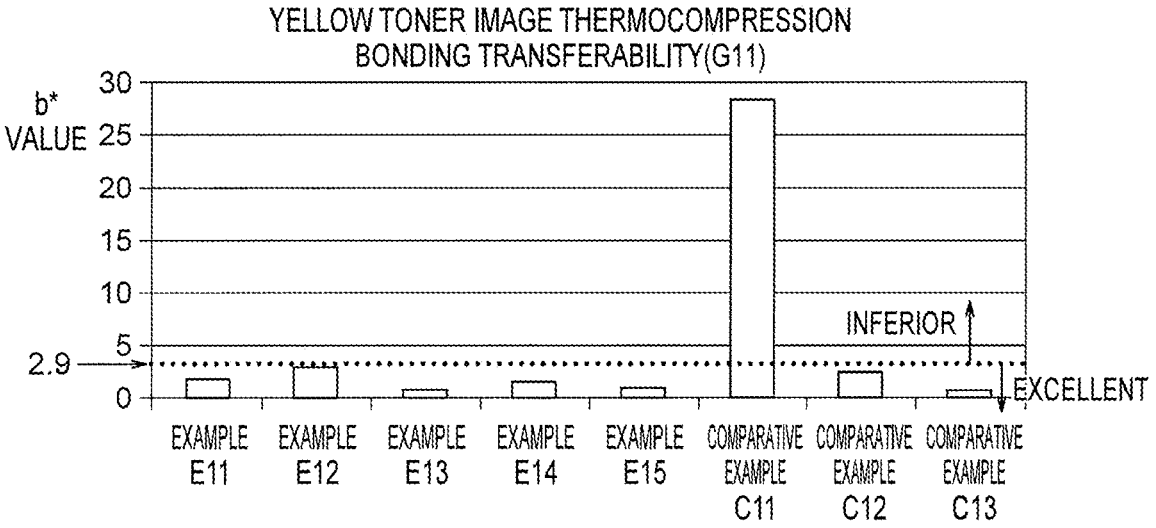
FIG. 21 is a diagram showing a result of the measurement of thermocompression bonding transferability of print images formed with the yellow toners (examples E11 to E15) as the toners according to the third embodiment and print images formed with the yellow toners in the comparative examples (examples C11 to C13) as a graph G11.

FIG. 21 is a diagram showing a result of the measurement of thermocompression bonding transferability of the thermocompression bonding transferability measurement print images formed with the yellow toners T11 to T15 (examples E11 to E15) according to the third embodiment and the thermocompression bonding transferability measurement print images formed with the yellow toners T16 to T18 in the comparative examples (comparative examples C11 to C13) as a graph G11.

As described above, the yellow color print hue of the yellow toners T11 to T18 in the examples E11 to E15 and the comparative examples C11 to C13 was measured as indicated by the graph G9 shown in FIG. 16. The light resistance F (%) of the toner images was measured as indicated by the graph G8 shown in FIG. 15. The sublimation resistance of the toner images was measured as indicated by the graph G10 shown in FIG. 19. The thermocompression bonding transferability of the toner images was measured as indicated by the graph G11 shown in FIG. 21.

As is clear from FIG. 15, FIG. 16, FIG. 19 and FIG. 21, the light resistance F (%) of the toner images with the yellow toners T11 to T15 in the examples E11 to E15 is excellent, the print hue of the toner images with the yellow toners T11 to T15 in the examples E11 to E15 is excellent, the sublimation resistance of the toner images with the yellow toners T11 to T15 in the examples E11 to E15 is excellent, and the thermocompression bonding transferability of the toner images with the yellow toners T11 to T15 in the examples E11 to E15 is excellent.

Further, it has been known that the tendency of the toner to be consolidated when subjected to a high-pressure and high-humidity environment (e.g., temperature: 50° C., humidity: 55%) increases with the decrease in the melt viscosity at 120° C. Such high-pressure and high-humidity environment presumes the severest environment to which the toner can be subjected during transportation. If components of the yellow toners T11 to T15 in the examples E11 to E15 are changed to make a toner whose melt viscosity η at 120° C. is lower than 1400 (Pa·s), the toner cannot maintain sufficiently high viscosity due to the consolidation of the toner in the aforementioned severest environment.

The lower limit 1400 (Pa·s) of the melt viscosity η in the aforementioned condition (3) is a lower limit for preventing the toner from falling into a state prone to consolidation.

As seen in Table 3 in FIG. 14 and FIG. 15 showing the result of the evaluation test using the yellow 100% density images with the yellow toners T11 to T18, the light resistance F (%) of the yellow toner T16 in the comparative example C11 is under 70% as the permissible value, whereas the light resistance F (%) of the other yellow toners T11 to T15, T17 and T18 is higher than or equal to the permissible value 70%.

Further, the sublimation resistance Sr (%) of the yellow toner T16 in the comparative example C11 is under 98% as the permissible value, whereas the sublimation resistance Sr (%) of the other yellow toners T11 to T15, T17 and T18 is higher than or equal to the permissible value 98%.

The sublimation resistance Sr (%) being higher than or equal to 98% can be regarded as a result obtained when sublimation hardly occurs to the toner, and thus the yellow toners T11 to T15, T17 and T18 can be regarded as excellent toners causing no problem due to sublimation.

Furthermore, as seen in FIG. 16 showing the result of the evaluation test using the yellow 100% density images with the yellow toners T11 to T18, the b* value of the print hue of the yellow toner T17 in the comparative example C12 is under 93.4 as the lower limit, whereas the b* values of the print hue of the other yellow toners T11 to T16 and T18 are higher than or equal to the lower limit 93.4.

Moreover, as seen in FIG. 21 showing a result of the measurement of thermocompression bonding transferability of the yellow toners T11 to T18, the b* value of the toner image with the yellow toner T16 in the comparative example C11 on the transfer paper after the thermocompression bonding transfer is over 2.9 as the upper limit, whereas the b* values regarding the other yellow toners T11 to T15, T17 and T18 are lower than or equal to the upper limit 2.9. The b* value being lower than or equal to 2.9 indicates that almost none of the toner image remains on the transfer paper after the thermocompression bonding transfer. Namely, the yellow toners T11 to T15, T17 and T18 can be regarded as toners having excellent thermocompression bonding transferability for the transfer of the entire toner image.

In other words, as the b* value exceeds 2.9, the color of the image on the fabric (e.g., T-shirt) becomes pale. Namely, the difference between the density of the image on the transfer paper and the density of the image after being transferred onto the fabric increases. As a result, when a person who purchased the transfer paper with the print image sees the fabric (e.g., T-shirt) onto which the image has been transferred from the transfer paper, the person is highly likely to feel that the result of the print on the fabric differs from expectation (color is pale).

As above, from the evaluation tests using the yellow 100% density images with the yellow toners T11 to T18, the yellow toners T11 to T15 and T18 can be judged to be excellent in the print hue, the light resistance, the sublimation resistance and the thermocompression bonding transferability.

(3-4) Evaluation Test of Toner According to Third Embodiment in Cases of Compound Color (3-4-1) Procedure of Evaluation Test of Toner in Cases of Compound Color Next, a description will be given of an evaluation test for judging the hue of the yellow toners T11 to T18 in the examples E11 to E15 and the comparative examples C11 to C13 in cases of compound color. In the evaluation test, a sheet that has undergone blank printing as shown in FIG. 6 is used. Further, in the evaluation test, a sheet having toner patches of a print pattern for the measurement of print hue as shown in FIG. 7 is used. Furthermore, in the evaluation test, toner patches of the types (colors and densities) shown in FIG. 8 are used as the toner patches of the print pattern for the measurement of print hue.

The evaluation test of toners in cases of compound color was performed similarly to the case of the second embodiment by using the color LED printer "C941dn" produced by Oki Data Corporation and loading the image forming section 10Y with each of the yellow toners T11 to T18 in the examples E11 to E15 and the comparative examples C11 to C13.

The evaluation of the hue was performed similarly to the case of the second embodiment.

The print medium used in this test was fine quality paper as white paper weighing 80 g/m$^2$ and satisfying the following conditions:

$$96.3 \leq L^*(W) \leq 96.8,$$

$$1.7 \leq a^*(W) \leq 2.0,$$

$$-5.6 \leq b^*(W) \leq -5.2, \text{ and}$$

$$78.0 \text{ (sec)} \leq \text{Beck smoothness} \leq 129.3 \text{ (sec)}$$

where L*(W), a* (W) and b* (W) respectively represent the L* value, the a* value and the b* value in the L*a*b* color model.

Specifically, the paper "Excellent White A4 (70 kg paper)" (produced by Oki Data Corporation) was used as the print medium. Incidentally, the Bekk smoothness was measured by using "DIGI-BEKK DB-2" (produced by Toyo Seiki Seisaku-sho, Ltd.) in conditions stipulated in "JIS P 8119".

The print pattern for the measurement of print hue is the same as that in the second embodiment (print pattern shown in FIG. 7 and FIG. 8).

In the judgment on the hue of the red 200% density image, the hue is judged to be excellent as the overall judgment when the judgment by a visual check and the judgment by the print hue of the red color are both excellent. The judgment by a visual check was made by using the red 200% density image in the print obtained by the test, in which the hue was judged to be excellent when the red 200% density image looks equivalent in hue to the red 200% density image obtained by using the yellow toner T16 in the comparative example C11.

(3-4-2) Result of Evaluation Test of Toner in Cases of Compound Color

The comparative example C1 in the second embodiment and the comparative example C11 in the third embodiment represent the same toner. Thus, the graph G3 in FIG. 8 and the graph G4 in FIG. 9 also indicate the characteristics of the comparative example C11 in the third embodiment. In regard to the result of the evaluation test in cases of compound color, the description about the comparative example C1 in the second embodiment applies also to the comparative example C11 in the third embodiment.

The result of the evaluation test performed by using the yellow toners T11 to T18 in the examples E11 to E15 and the comparative examples C11 to C13 to check the effect of the toners according to the third embodiment is shown in FIG. 22 as Table 4.

Figure 23:
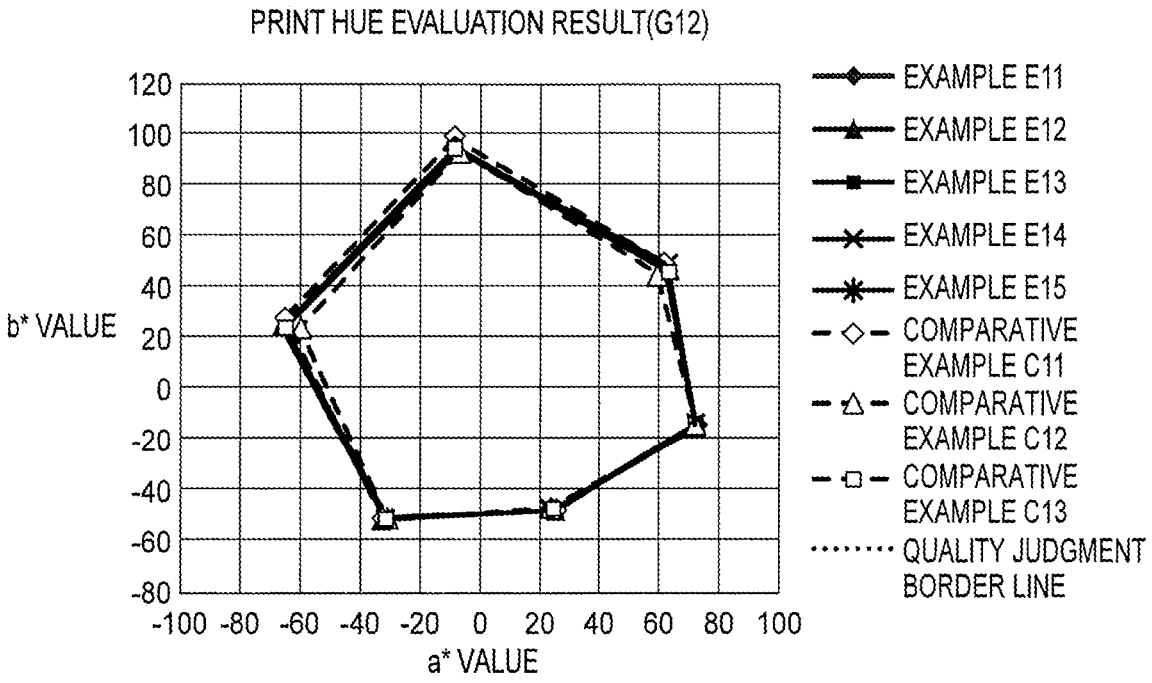
FIG. 23 is a diagram showing a result of evaluation of the print hue of toner patches of red 200% density images formed with each of the yellow toners in the examples E11 to E15 and the comparative examples C11 to C13 and the ordinary (commercially available) magenta toner as a graph G12 in the L*a*b* color model.

FIG. 23 is a diagram showing a result of evaluation of the print hue of the toner patches as the red 200% density images formed with each of the yellow toners T11 to T18 in the examples E11 to E15 and the comparative examples C11 to C13 and the ordinary (commercially available) magenta toner as a graph G12 in the L*a*b* color model. FIG. 24 is a diagram magnifying a principal part of the graph G12 of FIG. 23 as a graph G13.

As seen in Table 4 in FIG. 22, the hue of the red 200% density images formed by using the yellow toners T11 to T15 in the examples E11, E12, E13, E14 and E15 as the toners according to the third embodiment and the yellow toner T16 in the comparative example C11 was judged to be excellent as the result of the visual check judgment. In contrast, as seen in Table 4 in FIG. 22, the hue of the red 200% density images formed by using the yellow toners T17 and T18 in the comparative examples C12 and C13 was judged to be inferior as the result of the visual check judgment.

Figure 24:
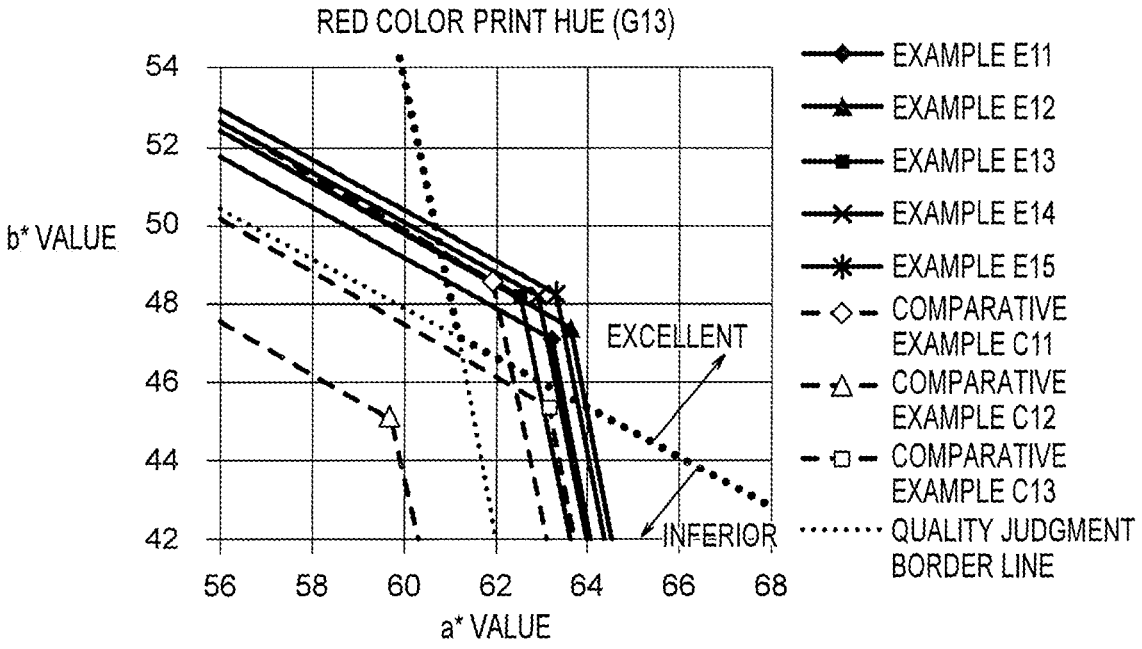
FIG. 24 is a diagram magnifying a principal part of the graph of FIG. 23 as a graph G13.

As seen in FIG. 24, the a* values and the b* values of the hue of the red 200% density images formed by using the yellow toners T11 to T15 in the examples E11, E12, E13, E14 and E15 as the toners according to the third embodiment and the yellow toner T16 in the comparative example C11 were on the excellent side (upper side) of the quality judgment border line and the hue of these red 200% density images was judged to be excellent. In contrast, as seen in FIG. 24, the a* values and the b* values of the hue of the red 200% density images formed by using the yellow toners T17 and T18 in the comparative examples C12 and C13 were on the inferior side (lower side) of the quality judgment border line and the hue of these red 200% density images was judged to be inferior.

It can be considered that the reason why the hue of the red 200% density images formed by using the yellow toners T17 and T18 in the comparative examples C12 and C13 was inferior is that the melt viscosity η was high (Table 3 in FIG. 14) and it was difficult to form an image in a condition in which the yellow toner and the magenta toner were more desirably molten and mixed together.

As shown in Table 4 in FIG. 22 as overall judgment, EXCELLENT was obtained as the overall judgment on the hue in the cases where the red 200% density images were formed by using the yellow toners T11 to T15 in the examples E11 to E15 as the toners according to the third embodiment and the yellow toner T16 in the comparative example C11. In the cases where the red 200% density images were formed by using the yellow toners T17 and T18 in the comparative examples C12 and C13, the overall judgment on the hue was inferior.

(3-5) Effect of Third Embodiment

According to the evaluation result of the print images with the yellow toners T11 to T18 shown in Table 3 in FIG. 14 and the evaluation result of the red 200% density images by using the yellow toners T11 to T18 shown in Table 4 in FIG. 22, both of the judgment on the yellow print image and the judgment on the red 200% density image resulted in excellent in the cases of using the yellow toners T11 to T15 in the examples E11 to E15.

Therefore, it becomes possible to form a print image having an excellent color tone, excelling in the light resistance, excelling in the sublimation resistance, and excelling in the thermocompression bonding transferability by configuring the toner according to the third embodiment to satisfy the aforementioned conditions (1), (2) and (3) and to satisfy the aforementioned conditions (4), (5) and (6).

(4) Modifications

While the image forming apparatus 1 according to the first embodiment is a printer of the intermediate transfer type secondarily transferring toner images primarily transferred onto the intermediate transfer belt 9 onto the sheet 23 by using the transfer roller 27, the present invention is applicable also to printers, facsimile machines and multifunction peripherals directly transferring toner images from the image forming sections 10W, 10Y, 10M, 10C and 10K to the sheet 23.

While examples using emulsion polymerization for the manufacturing of the toner were described in the second and third embodiments, the manufacturing method of base particles of the toner is not limited to emulsion polymerization. The manufacturing method of the toner base particles can also be a different method such as pulverization, suspension polymerization or dissolution suspension, for example.

What is claimed is:

1. A toner comprising:

binder resin; and a coloring agent provided in the binder resin, wherein the coloring agent is configured so that hue of a hue measurement print image printed on a print medium with the toner satisfies $$-8.6 \leq a^*(Y) \leq -7.9 \text{ and } 93.4 \leq b^*(Y) \leq 95.4$$

where a*(Y) and b*(Y) respectively represent an a* value and a b* value of the hue measurement print image in an L*a*b* color model, light resistance F of a light resistance measurement print image printed on a print medium with the toner, after an irradiation test in which the light resistance measurement print image is irradiated with light having 0.36 $W/m^2$ spectral irradiance at a wavelength of 340 nm for 663 hours satisfies $$F \geq 70\%, \text{ and}$$

the light resistance F is obtained as $$F\ (\%) = (D(E)/D(S)) \times 100(\%)$$

where D(E) represents optical density of a 100% density image with the toner after the irradiation test and D(S) represents optical density of the 100% density image with the toner before the irradiation test, and wherein the toner is configured so that melt viscosity η of the toner at 120° C. satisfies $$1400(\text{Pa}\cdot\text{s}) \leq \eta \leq 1600(\text{Pa}\cdot\text{s}).$$

2. The toner according to claim 1, wherein the coloring agent includes a plurality of pigments, and the plurality of pigments include C.I. Pigment Yellow 155 and C.I. Pigment Yellow 185.

3. The toner according to claim 2, wherein a mixture ratio of the C.I. Pigment Yellow 155 and the C.I. Pigment Yellow 185 is 4:1.

4. The toner according to claim 1, wherein the a*(Y) and the b*(Y) of the hue measurement print image printed on the print medium are values measured by using an underlay made by stacking five sheets of white paper as a first underlay for the print medium, the white paper as the first underlay satisfying $$96.3 \leq L^*(W) \leq 96.8,$$

$$1.7 \leq a^*(W) \leq 2.0, \text{ and}$$

$$-5.6 \leq b^*(W) \leq -5.2$$

where L*(W), a*(W) and b*(W) respectively represent an L* value, the a* value and the b* value in the L*a*b* color model, and by setting a color model setting at the L*a*b* color model, setting an observation light source setting at D50, and setting a viewing angle setting at 2° in a measuring instrument used for the measurement of the hue of the hue measurement print image printed on the print medium.

5. The toner according to claim 1, wherein optical density of the hue measurement print image printed on the print medium is a value measured by using black paper as an underlay for the print medium, the black paper satisfying $$25.1 \leq L^*(B) \leq 25.9,$$

$$0.2 \leq a^*(B) \leq 0.3, \text{ and}$$

$$0.5 \leq b^*(B) \leq 0.7$$

where L*(B), a*(B) and b*(B) respectively represent an L* value, the a* value and the b* value in the L*a*b* color model, and by setting a status setting at status I, setting a white reference setting at absolute white reference, and setting a filer setting at no polarizing filter in a measuring instrument used for the measurement of the optical density of the hue measurement print image.

6. The toner according to claim 1, wherein the light resistance F is percentage representation of a value obtained by dividing second optical density of the light resistance measurement print image with the toner after the irradiation test by first optical density of the light resistance measurement print image with the toner before the irradiation test, and the first optical density and the second optical density are values measured by using an underlay made by stacking five sheets of white paper as a second underlay for the print medium of the light resistance measurement print image, the white paper as the second underlay satisfying $$96.3 \leq L^*(W) \leq 96.8,$$

$$1.7 \leq a^*(W) \leq 2.0, \text{ and}$$

$$-5.6 \leq b^*(W) \leq -5.2$$

where L*(W), a*(W) and b*(W) respectively represent an L* value, the a* value and the b* value in the L*a*b* color model, and by setting a status setting at status I, setting a white reference setting at absolute white reference, and setting a filer setting at no polarizing filter in a measuring instrument used for the measurement of the optical density of the light resistance measurement print image.

7. The toner according to claim 1, wherein the toner is configured so that sublimation resistance Sr of a sublimation resistance measurement print image printed on the print medium with the toner, after a heating test heating the sublimation resistance measurement print image on a heat source at 180° C. for 10 minutes, satisfies $$Sr \geq 98\%, \text{ and}$$

the sublimation resistance Sr is obtained as $$Sr\ (\%) = (b^*(E)/b^*(S)) \times 100(\%)$$

where b*(E) represents the b* value of a 100% density image with the toner after the heating test and b*(S) represents the b* value of the 100% density image with the toner before the heating test, and wherein the toner is configured so that the b* value of a thermocompression bonding transferability measurement print image with the toner printed on transfer paper for thermocompression bonding transfer, after undergoing a press at 180° C. and 60 psi for 10 seconds, satisfies $$b^* \leq 2.9.$$

8. The toner according to claim 7, wherein the coloring agent includes a plurality of pigments, and the plurality of pigments include C.I. Pigment Yellow 155 and C.I. Pigment Yellow 185.

9. The toner according to claim 8, wherein a mixture ratio of the C.I. Pigment Yellow 155 and the C.I. Pigment Yellow 185 is within a range from 73:27 to 80:20.

10. The toner according to claim 7, wherein the a*(Y) and the b*(Y) of the hue measurement print image printed on the print medium are measured by using white paper weighing 80 g/m$^2$ as an underlay for the print medium, the white paper satisfying $$96.3 \leq L^*(W) \leq 96.8,$$

$$1.7 \leq a^*(W) \leq 2.0,$$

$$-5.6 \leq b^*(W) \leq -5.2, \text{ and}$$

$$78.0 \text{ (sec)} \leq \text{Beck smoothness} \leq 129.3 \text{ (sec)}$$

where L*(W), a*(W) and b*(W) respectively represent an L* value, the a* value and the b* value in the L*a*b* color model, using status I stipulated in ISO, absolute white reference, and no polarizing filter as conditions of density measurement in a measuring instrument used for the measurement of the optical density of the hue measurement print image, and using the hue measurement print image with the toner printed so that yellow optical density equals 1.4.

11. The toner according to claim 7, wherein the b*(S) and the b*(E) of the sublimation resistance measurement print image printed on the print medium are measured by using black paper as an underlay, the black paper satisfying $$25.1 \leq L^*(B) \leq 25.9,$$

$$0.2 \leq a^*(B) \leq 0.3, \text{ and}$$

$$0.5 \leq b^*(B) \leq 0.7$$

where L*(B), a*(B) and b*(B) respectively represent an L* value, the a* value and the b* value in the L*a*b* color model, using status I stipulated in ISO, absolute white reference, and no polarizing filter as conditions of density measurement in a measuring instrument used for the measurement of the optical density of the hue measurement print image, and using the sublimation resistance measurement print image with the toner printed so that yellow optical density equals 1.4.

12. The toner according to claim 1, wherein the binder resin is styrene-acrylic copolymer resin.

13. A toner cartridge comprising:

a toner storage container that can be attached to a development device for supplying a toner to a surface of an image bearing body; and a toner that is being stored in the toner storage container, wherein the toner that is being stored in the toner storage container is the toner according to claim 1.

14. A development device comprising:

a toner storage part;

a toner that is being stored in the toner storage part; and a toner bearing body that supplies the toner that is being stored in the toner storage part to a surface of an image bearing body bearing an electrostatic latent image, wherein the toner that is being stored in the toner storage part is the toner according to claim 1.

15. An image forming apparatus comprising:

an image bearing body that bears an electrostatic latent image;

a development device including a toner storage part;

a toner that is being stored in the toner storage part; and a transfer unit that transfers a toner image foamed on the image bearing body by the toner supplied from the development device, onto a print medium, wherein the toner that is being stored in the toner storage part is the toner according to claim 1.

* * * * *